US007585389B2

(12) United States Patent
Yeh et al.

(10) Patent No.: US 7,585,389 B2
(45) Date of Patent: Sep. 8, 2009

(54) METHOD OF MAKING FABRIC-CREPED SHEET FOR DISPENSERS

(75) Inventors: Kang C. Yeh, Neenah, WI (US); Stephen J. McCullough, Mount Calvary, WI (US); Hung Liang Chou, Neenah, WI (US); Mark S. Hunter, Denmark, WI (US); Thomas E. Lyse, Vancouver, WA (US); Ronald R. Reeb, DePere, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

(21) Appl. No.: 11/451,111

(22) Filed: Jun. 12, 2006

(65) Prior Publication Data

US 2006/0289134 A1 Dec. 28, 2006

Related U.S. Application Data

(60) Provisional application No. 60/693,699, filed on Jun. 24, 2005.

(51) Int. Cl.
*B31F 1/12* (2006.01)
*D21H 11/00* (2006.01)

(52) U.S. Cl. ..... 162/111; 162/147; 162/158; 162/164.1; 162/168.3

(58) Field of Classification Search ..... 162/109, 162/111–113, 115–117, 123–133, 193, 147, 162/158, 164.1, 168.1, 168.3, 197, 204–205; 156/183; 264/282–283; 226/7, 91, 97.3; 34/114, 117, 122, 359, 444
See application file for complete search history.

(56) References Cited

U.S. PATENT DOCUMENTS

| | | | | |
|---|---|---|---|---|
| 2,926,116 | A | 2/1960 | Keim | 162/164 |
| 3,058,873 | A | 12/1962 | Keim et al. | 162/164 |
| 3,432,936 | A | 3/1969 | Cole et al. | 34/6 |
| 3,556,932 | A | 1/1971 | Coscia et al. | 162/166 |
| 3,556,933 | A | 1/1971 | Williams et al. | 162/167 |
| 3,700,623 | A | 10/1972 | Keim | 260/80.3 R |
| 3,772,076 | A | 11/1973 | Keim | 162/164.3 |
| 3,974,025 | A | 8/1976 | Ayers | 162/113 |
| 3,994,771 | A | 11/1976 | Morgan, Jr. et al. | 162/113 |
| 4,102,737 | A | 7/1978 | Morton | 162/113 |
| 4,225,382 | A | 9/1980 | Kearney et al. | 162/11 |
| 4,239,065 | A | 12/1980 | Trokhan | 139/383 AA |
| 4,356,059 | A | 10/1982 | Hostetler | 162/111 |
| 4,420,372 | A | 12/1983 | Hostetler | 162/280 |
| 4,440,597 | A * | 4/1984 | Wells et al. | 162/111 |
| 4,445,638 | A | 5/1984 | Connell et al. | 237/8 R |
| 4,448,638 | A | 5/1984 | Klowak | 162/112 |
| 4,468,254 | A | 8/1984 | Yokoyama et al. | 106/271 |
| 4,482,429 | A | 11/1984 | Klowak | 162/111 |
| 4,490,925 | A | 1/1985 | Smith | 34/42 |
| 4,528,316 | A | 7/1985 | Soerens | 162/109 |
| 4,529,480 | A | 7/1985 | Trokhan | 162/109 |
| 4,543,156 | A | 9/1985 | Cheshire et al. | 162/101 |
| 4,551,199 | A | 11/1985 | Weldon | 162/109 |
| 4,552,709 | A | 11/1985 | Koger, II et al. | 264/504 |
| 4,556,450 | A | 12/1985 | Chuang et al. | 162/204 |
| 4,605,702 | A | 8/1986 | Cuerro et al. | 525/154 |
| 4,614,679 | A | 9/1986 | Farrington, Jr. et al. | 428/138 |
| 4,637,859 | A | 1/1987 | Trokhan | 162/109 |
| 4,689,119 | A | 8/1987 | Weldon | 162/281 |
| 4,720,383 | A | 1/1988 | Drach et al. | 424/70 |
| 4,795,530 | A | 1/1989 | Soerens et al. | 162/11 |
| 4,803,032 | A | 2/1989 | Schulzz | 264/284 |
| 4,834,838 | A | 5/1989 | Klowak | 162/109 |
| 4,849,054 | A | 7/1989 | Klowak | 162/109 |
| 4,942,077 | A | 7/1990 | Wendt et al. | 428/152 |
| 5,087,324 | A | 2/1992 | Awofeso et al. | 162/111 |
| 5,129,988 | A | 7/1992 | Farrington, Jr. et al. | 162/123 |
| 5,215,617 | A | 6/1993 | Grupe | 156/209 |
| 5,223,096 | A | 6/1993 | Phan et al. | 162/158 |
| 5,262,007 | A | 11/1993 | Phan et al. | 162/158 |
| 5,264,082 | A | 11/1993 | Phan et al. | 162/158 |
| 5,312,522 | A | 5/1994 | Phan et al. | 162/111 |
| 5,314,584 | A | 5/1994 | Grinnell et al. | 162/109 |
| 5,336,373 | A | 8/1994 | Scattolino et al. | 162/116 |
| 5,338,807 | A | 8/1994 | Espy et al. | 525/430 |
| 5,348,620 | A | 9/1994 | Hermans et al. | 162/9 |

(Continued)

FOREIGN PATENT DOCUMENTS

| | | | |
|---|---|---|---|
| CA | 22053505 | | 4/1992 |
| WO | WO 00/14330 | A1 | 3/2000 |
| WO | WO 01/85109 | A1 | 11/2001 |
| WO | WO 2004033793 | A2 * | 4/2004 |
| WO | WO 2005103375 | A1 * | 11/2005 |
| WO | WO 2005106117 | A1 * | 11/2005 |
| WO | WO 2006113025 | A2 * | 10/2006 |
| WO | WO 2007001837 | A2 * | 1/2007 |
| WO | WO 2007139726 | A1 * | 12/2007 |

OTHER PUBLICATIONS

Chapter 2: Alkaline-Curing Polymeric Amine-Epichlorhydrin by Espy in Wet Strength Resins and Their Application (L. Chan, Editor, 1994); Trifedi et al., J. Am. Oil Chemist's Soc., Jun. 1981, pp. 754-756.
Westfelt in Cellulose Chemistry and Technology, vol. 13, p. 813, 1979; Egan, J.Am. Oil Chemist's Soc., vol. 55 (1978), pp. 118-121; and Evans, Chemistry and Industry, Jul. 5, 1969, pp. 893-903.
U.S. Appl. No. 11/867,113, filed Oct. 4, 2007, Kokko et al.
U.S. Appl. No. 11/804,246, filed May 16, 2007, Edwards et al.
U.S. Appl. No. 11/678,669, filed Feb. 26, 2007, Chou et al.
U.S. Appl. No. 60/903,789, filed Feb. 27, 2007, Chou et al.
U.S. Appl. No. 60/881.310, filed Jan. 19, 2007, Sumnicht.

*Primary Examiner*—José A Fortuna
(74) *Attorney, Agent, or Firm*—Michael W. Ferrell

(57) ABSTRACT

Fabric-creped absorbent sheet has an MD bending length of about 3.5 cm or more as well as an absorbency of about 3 g/g or more. The sheet is preferably produced without through drying or dry creping and is a low-dust product especially suitable for automatic towel dispensers.

57 Claims, 13 Drawing Sheets

U.S. PATENT DOCUMENTS

| | | | | |
|---|---|---|---|---|
| 5,366,785 | A | 11/1994 | Sawdai | 428/156 |
| 5,411,636 | A | 5/1995 | Hermans et al. | 162/109 |
| 5,415,737 | A | 5/1995 | Phan et al. | 162/111 |
| 5,431,840 | A | 7/1995 | Soldanski et al. | 510/241 |
| 5,449,026 | A | 9/1995 | Lee | 139/383 A |
| 5,492,598 | A | 2/1996 | Hermans et al. | 162/113 |
| 5,494,554 | A | 2/1996 | Edwards et al. | 162/111 |
| 5,501,768 | A | 3/1996 | Hermans et al. | 162/9 |
| 5,503,715 | A | 4/1996 | Trokhan et al. | 162/296 |
| 5,505,818 | A | 4/1996 | Hermans et al. | 162/113 |
| 5,508,818 | A | 4/1996 | Hamma | 358/403 |
| 5,510,001 | A | 4/1996 | Hermans et al. | 162/113 |
| 5,510,002 | A | 4/1996 | Hermans et al. | 162/113 |
| 5,549,790 | A | 8/1996 | Van Phan | 162/109 |
| 5,556,509 | A | 9/1996 | Trokhan et al. | 162/111 |
| 5,593,545 | A | 1/1997 | Rugowski et al. | 162/207 |
| 5,601,871 | A | 2/1997 | Krzysik et al. | 427/288 |
| 5,607,551 | A | 3/1997 | Farrington, Jr. et al. | 162/109 |
| 5,609,725 | A | 3/1997 | Van Phan | 162/117 |
| 5,614,293 | A | 3/1997 | Krzysik et al. | 428/211 |
| H1672 | H | 8/1997 | Hermans et al. | |
| 5,656,132 | A | 8/1997 | Farrington, Jr. et al. | 162/117 |
| 5,667,636 | A | 9/1997 | Engel et al. | 162/117 |
| 5,672,248 | A | 9/1997 | Wendt et al. | 162/109 |
| 5,674,590 | A | 10/1997 | Anderson et al. | 428/154 |
| 5,690,149 | A | 11/1997 | Lee | 139/383 A |
| 5,695,607 | A | 12/1997 | Oriaran et al. | 162/112 |
| 5,725,734 | A * | 3/1998 | Herman et al. | 162/111 |
| 5,746,887 | A | 5/1998 | Wendt et al. | 162/109 |
| 5,772,845 | A | 6/1998 | Farrington, Jr. et al. | 162/109 |
| 5,814,190 | A | 9/1998 | Van Phan | 162/111 |
| 5,830,321 | A * | 11/1998 | Lindsay et al. | 162/204 |
| 5,840,403 | A | 11/1998 | Trokhan et al. | 428/154 |
| 5,851,353 | A | 12/1998 | Fiscus et al. | 162/113 |
| 5,888,347 | A | 3/1999 | Engel et al. | 162/117 |
| 5,932,068 | A | 8/1999 | Farrington, Jr. et al. | 162/117 |
| 5,935,381 | A | 8/1999 | Trokhan et al. | 162/109 |
| 5,961,782 | A | 10/1999 | Luu et al. | 162/111 |
| 6,017,417 | A | 1/2000 | Wendt et al. | 162/109 |
| 6,033,736 | A | 3/2000 | Perlman et al. | 427/384 |
| 6,080,279 | A | 6/2000 | Hada et al. | 162/115 |
| 6,083,346 | A | 7/2000 | Hermans et al. | 162/115 |
| 6,093,284 | A | 7/2000 | Hada et al. | 162/290 |
| 6,096,169 | A | 8/2000 | Hermans et al. | 162/115 |
| 6,117,525 | A | 9/2000 | Trokhan et al. | 428/154 |
| 6,133,405 | A | 10/2000 | Allen | 528/310 |
| 6,136,146 | A | 10/2000 | Van Phan et al. | 162/109 |
| 6,139,686 | A | 10/2000 | Trokhan et al. | 162/109 |
| 6,143,135 | A | 11/2000 | Hada et al. | 162/290 |
| 6,149,767 | A | 11/2000 | Hermans et al. | 162/111 |
| 6,149,769 | A | 11/2000 | Mohammadi et al. | 162/111 |
| 6,161,303 | A | 12/2000 | Beck | 34/199 |
| 6,162,327 | A | 12/2000 | Batra et al. | 162/109 |
| 6,171,442 | B1 | 1/2001 | Farrington, Jr. et al. | 162/129 |
| 6,187,137 | B1 | 2/2001 | Druecke et al. | 162/109 |
| 6,190,506 | B1 | 2/2001 | Beck | 162/357 |
| 6,197,154 | B1 | 3/2001 | Chen et al. | 162/109 |
| 6,207,011 | B1 | 3/2001 | Luu et al. | 162/111 |
| 6,210,528 | B1 | 4/2001 | Wolkowicz | 162/111 |
| 6,228,220 | B1 | 5/2001 | Hada et al. | 162/203 |
| 6,248,203 | B1 | 6/2001 | Beck | 156/286 |
| 6,274,042 | B1 | 8/2001 | Beck | 210/500.27 |
| 6,280,573 | B1 | 8/2001 | Lindsay et al. | 162/198 |
| 6,287,426 | B1 | 9/2001 | Edwards et al. | |
| 6,287,427 | B1 | 9/2001 | Beck | 162/360.3 |
| 6,306,257 | B1 | 10/2001 | Hada et al. | 162/290 |
| 6,306,258 | B1 | 10/2001 | Lange et al. | 162/290 |
| 6,318,727 | B1 | 11/2001 | Hada | 277/345 |
| 6,321,963 | B1 | 11/2001 | Gracyalny et al. | 225/2 |
| 6,331,230 | B1 | 12/2001 | Hermans et al. | 162/207 |
| 6,350,349 | B1 | 2/2002 | Hermans et al. | 162/111 |
| 6,379,496 | B2 | 4/2002 | Edwards et al. | 162/111 |
| 6,381,868 | B1 | 5/2002 | Grabscheid et al. | 34/114 |
| 6,412,678 | B2 | 7/2002 | Gracyalny et al. | 225/2 |
| 6,416,631 | B1 | 7/2002 | Beck | 162/360.3 |
| 6,419,793 | B1 | 7/2002 | Beck | 428/154 |
| 6,420,013 | B1 | 7/2002 | Vinson et al. | 428/154 |
| 6,432,267 | B1 | 8/2002 | Watson | 162/111 |
| 6,436,234 | B1 | 8/2002 | Chen et al. | 162/109 |
| 6,447,640 | B1 | 9/2002 | Watson et al. | 162/101 |
| 6,447,641 | B1 | 9/2002 | Wolkowicz et al. | 162/109 |
| 6,454,904 | B1 | 9/2002 | Hermans et al. | 162/205 |
| 6,461,474 | B1 | 10/2002 | Lindsay et al. | 162/109 |
| 6,464,829 | B1 | 10/2002 | Chen et al. | 162/109 |
| 6,478,927 | B1 | 11/2002 | Chen et al. | 162/109 |
| 6,497,789 | B1 | 12/2002 | Hermans et al. | 162/205 |
| 6,534,151 | B2 | 3/2003 | Merker | 428/154 |
| 6,547,924 | B2 | 4/2003 | Klerelid et al. | 162/109 |
| 6,551,461 | B2 | 4/2003 | Hermans et al. | 162/207 |
| 6,562,198 | B2 | 5/2003 | Beck et al. | 162/360.3 |
| 6,565,707 | B2 | 5/2003 | Behnke et al. | 162/112 |
| 6,579,418 | B2 | 6/2003 | Lindsay et al. | 162/198 |
| 6,585,855 | B2 | 7/2003 | Drew et al. | 162/109 |
| 6,589,394 | B2 | 7/2003 | Beck | 162/360.3 |
| 6,592,067 | B2 | 7/2003 | Denen et al. | 242/560 |
| 6,607,638 | B2 | 8/2003 | Drew et al. | 162/204 |
| 6,610,173 | B1 | 8/2003 | Lindsay et al. | 162/109 |
| 6,616,812 | B2 | 9/2003 | Beck | 162/358.2 |
| 6,645,420 | B1 | 11/2003 | Beck | 264/504 |
| 6,746,558 | B2 | 6/2004 | Hoeft et al. | 156/209 |
| 6,766,977 | B2 | 7/2004 | Denen et al. | 242/563 |
| 6,793,170 | B2 | 9/2004 | Denen et al. | 242/560 |
| 6,838,887 | B2 | 1/2005 | Denen et al. | 324/686 |
| 6,871,815 | B2 | 3/2005 | Moody et al. | 242/559.2 |
| 7,494,563 | B2 * | 2/2009 | Edwards et al. | 162/109 |
| 2002/0062936 | A1 | 5/2002 | Klerelid et al. | 162/16 |
| 2002/0088577 | A1 | 7/2002 | Watson et al. | 162/109 |
| 2002/0134520 | A1 | 9/2002 | Behnke et al. | 162/100 |
| 2003/0000664 | A1 | 1/2003 | Drew et al. | 162/109 |
| 2003/0056919 | A1 | 3/2003 | Beck | 162/199 |
| 2003/0056921 | A1 | 3/2003 | Beck et al. | 162/290 |
| 2003/0056922 | A1 | 3/2003 | Beck | 162/290 |
| 2003/0056923 | A1 | 3/2003 | Beck | 162/290 |
| 2003/0056925 | A1 | 3/2003 | Beck | 162/358.1 |
| 2003/0098134 | A1 | 5/2003 | Scherb et al. | 162/117 |
| 2003/0102098 | A1 | 6/2003 | Allen et al. | 162/203 |
| 2003/0111195 | A1 | 6/2003 | Hu | 162/111 |
| 2003/0121626 | A1 | 7/2003 | Hultzerantz | 162/111 |
| 2003/0146581 | A1 | 8/2003 | Beck | 277/159 |
| 2003/0153443 | A1 | 8/2003 | Beck | 492/159 |
| 2004/0089168 | A1 | 5/2004 | Beck | 100/159 |
| 2005/0217814 | A1 * | 10/2005 | Super et al. | 162/111 |
| 2005/0241787 | A1 * | 11/2005 | Murray et al. | 162/113 |
| 2005/0279471 | A1 * | 12/2005 | Murray et al. | 162/111 |
| 2006/0000567 | A1 * | 1/2006 | Murray et al. | 162/111 |
| 2006/0237154 | A1 * | 10/2006 | Edwards et al. | 162/111 |
| 2006/0289133 | A1 * | 12/2006 | Yeh et al. | 162/109 |
| 2006/0289134 | A1 * | 12/2006 | Yeh et al. | 162/111 |
| 2007/0107863 | A1 * | 5/2007 | Edwards et al. | 162/111 |
| 2008/0008860 | A1 * | 1/2008 | Murray et al. | 428/152 |
| 2008/0008865 | A1 * | 1/2008 | Luu et al. | 428/219 |
| 2008/0029235 | A1 * | 2/2008 | Edwards et al. | 162/111 |
| 2008/0047675 | A1 * | 2/2008 | Murray et al. | 162/101 |
| 2008/0083519 | A1 * | 4/2008 | Kokko et al. | 162/9 |
| 2008/0236772 | A1 * | 10/2008 | Edwards et al. | 162/112 |
| 2008/0245492 | A1 * | 10/2008 | Edwards et al. | 162/111 |
| 2009/0038768 | A1 * | 2/2009 | Murray et al. | 162/111 |

* cited by examiner

UNCREPED TAD SIDE 1 (10x)

UNCREPED TAD SIDE 2 (10x)

FABRIC CREPE AIR SIDE (10x)

FABRIC CREPE YANKEE SIDE (10x)

METHOD OF MAKING FABRIC-CREPED SHEET FOR DISPENSERS

CROSS-REFERENCE TO RELATED APPLICATION

This application is based upon U.S. Provisional application Ser. No. 60/693,699, filed Jun. 24, 2005, of the same title. The priority of Provisional Application Ser. No. 60/693,699 is hereby claimed and its disclosure incorporated by reference into this application in its entirety. This application also relates to U.S. patent application Ser. No. 11/451,112, entitled "Fabric-Creped Sheet for Dispensers", by the same inventors, filed on Jun. 12, 2006.

TECHNICAL FIELD

The present invention relates generally to wet-pressed absorbent sheet and more particularly to wet-pressed, fabric creped sheet peeled from a Yankee dryer. The sheet exhibits elevated absorbency and MD stretch as well as an MD bending length especially suitable for automatic towel dispensers.

BACKGROUND ART

Methods of making paper tissue, towel, and the like are well known, including various features such as Yankee drying, throughdrying, fabric creping, dry creping, wet creping and so forth. Conventional wet pressing/dry creping processes have certain advantages over conventional through-air drying processes including: (1) lower energy costs associated with the mechanical removal of water rather than transpiration drying with hot air; and (2) higher production speeds which are more readily achieved with processes which utilize wet pressing to form a web. On the other hand, through-air drying processing has been widely adopted for new capital investment, particularly for the production of soft, bulky, premium quality towel products.

Fabric creping has been employed in connection with papermaking processes which include mechanical or compactive dewatering of the paper web as a means to influence product properties. See U.S. Pat. Nos. 4,689,119 and 4,551,199 to Weldon; 4,849,054 and 4,834,838 to Klowak; and 6,287,426 to Edwards et al. Operation of fabric creping processes has been hampered by the difficulty of effectively transferring a web of high or intermediate consistency to a dryer. Note also U.S. Pat. No. 6,350,349 to Hermans et al. which discloses wet transfer of a web from a rotating transfer surface to a fabric. Further United States Patents relating to fabric creping more generally include the following: U.S. Pat. Nos. 4,834,838; 4,482,429; 4,445,638 as well as U.S. Pat. No. 4,440,597 to Wells et al. Typically, the fabric creped webs are dried, then dry-creped.

Throughdried, creped products are disclosed in the following patents: U.S. Pat. No. 3,994,771 to Morgan, Jr. et al.; U.S. Pat. No. 4,102,737 to Morton; and U.S. Pat. No. 4,529,480 to Trokhan. The processes described in these patents comprise, very generally, forming a web on a foraminous support, thermally pre-drying the web, applying the web to a Yankee dryer with a nip defined, in part, by an impression fabric, and creping the product from the Yankee dryer. A relatively permeable web is typically required, making it difficult to employ recycle furnish at levels which may be desired. Transfer to the Yankee typically takes place at web consistencies of from about 60% to about 70%. See also, U.S. Pat. No. 6,187,137 to Druecke et al. which includes disclosure of peeling a web from a Yankee dryer.

As noted in the above, throughdried products tend to exhibit enhanced bulk and softness; however, thermal dewatering with hot air tends to be energy intensive. Wet-press/dry crepe operations wherein the webs are mechanically dewatered are preferable from an energy perspective and are more readily applied to furnishes containing recycle fiber which tends to form webs with less uniform permeability than virgin fiber. Moreover, line speeds tend to be higher with wet-press operations.

Automatic towel dispensers introduced in recent years are preferred in many respects by consumers, business establishments and institutions since better hygiene and superior dispensing control is provided. Such dispensers are seen in the following patents: Sheet Material Dispenser with Perforation Sensor and Method, U.S. Pat. No. 6,766,977 to Denen et al. which discloses a paper dispenser releasing individual sheets of paper in response to movement (once the dispenser detects movement, it releases paper and activates a perforation sensor to stop advancement of the roll of paper after a set number of rotations); Waste Minimizing Paper Dispenser, U.S. Pat. No. 6,793,170 to Denen et al. describes a dispenser for dispensing paper from two rolls, the dispenser releases paper from the first roll until a sensor detects its reduction to a predetermined size whereupon the dispenser releases paper from both rolls until one of the rolls is depleted; Minimizing Paper Waste Carousel-Style Dispenser, Sensor, Method and System with Proximity Sensor, U.S. Pat. No. 6,592,067 to Denen et al. which discloses and claims an apparatus dispensing paper upon detection of a hand next to it which has a movement sensor containing an electrical circuit measuring change of capacitance as a result of proximity of a hand; see also Proximity Detection Circuit and Method of Detecting Small Capacitance Changes, U.S. Pat. No. 6,838,887 where there is described a second miniaturized circuit which is added for detecting proximity of a hand; as well as Static Build Up in Electronic Dispensing System U.S. Pat. No. 6,871,815 to Moody et al. which provides for a system for dissipating static electrical build-up to local ground via a metal contact between the high conductivity pathway and, for example, the wall against which the dispenser is mounted. Further features are seen in U.S. Pat. Nos. 6,412,678 and 6,321,963 to Gracyalny et al.

It has been found that unacceptable dispensing failure rates are experienced when using typical wet-pressed/dry creped towel in these automatic dispensers, so much so that relatively expensive throughdried products with relatively high bending length are ordinarily required with these very popular automatic dispensers.

It has been found in accordance with the present invention that wet pressed/fabric creped towel with a unique combination of properties suitable for automatic dispensers can be produced without dry creping provided the wet-press manufacturing process is suitably controlled. The present invention thus provides economical feedstock for automatic dispensers which readily incorporates recycle fiber and which may be produced at higher line speeds and with lower energy costs than throughdried products.

SUMMARY OF THE INVENTION

There is provided in accordance with the present invention a manufacturing method for fabric-creped sheet which includes peeling, rather than creping the product from a Yankee dryer. The product has more MD stretch than uncreped throughdried products (discussed below) and more stiffness or MD bending length than dry-creped products for dispensing reliability.

There is provided in one aspect of the invention a method of making a fabric-creped absorbent cellulosic sheet with improved dispensing characteristics comprising: a) compactively dewatering a papermaking furnish to form a nascent web; b) applying the dewatered web to a translating transfer surface moving at a first speed; c) fabric-creping the web from the transfer surface at a consistency of from about 30 to about 60 percent utilizing a patterned creping fabric, the creping step occurring under pressure in a fabric creping nip defined between the transfer surface and the creping fabric wherein the fabric is traveling at a second speed slower than the speed of said transfer surface, the fabric pattern, nip parameters, velocity delta and web consistency being selected such that the web is creped from the transfer surface and transferred to the creping fabric; d) adhering the web to a drying cylinder with a resinous adhesive coating composition; e) drying the web on the drying cylinder; and f) peeling the web from the drying cylinder. The furnish, creping fabric and creping adhesive are selected and the velocity delta, nip parameters and web consistency, caliper and basis weight are controlled such that the MD bending length of the dried web is at least about 3.5 cm. Generally, the MD bending length of the dried web is from about 3.5 cm to about 5 cm. and more preferably the MD bending length of the dried web is from about 3.75 cm to about 4.5 cm.

The process is suitably operated at a fabric crepe of from about 3.5% to about 30%; typically operated at a fabric crepe of from about 5% to about 15%.

The dried web generally exhibits a WAR value of less than about 35 seconds; typically, the dried web exhibits a WAR value of less than about 30 or less than about 25 seconds such as a WAR value of from about 10 to about 20 seconds.

The papermaking furnish typically comprises a wet strength resin as well as a dry strength resin. In a preferred embodiment, the papermaking furnish comprises a wet strength resin and as a dry strength resin carboxymethyl cellulose and/or polyacrylamide, with the proviso that the wet strength resin add-on rate is less than about 20 lbs per ton of papermaking fiber.

A creping adhesive is also used. In preferred embodiments the resinous adhesive coating composition is employed at an add-on rate of less than about 40 mg/m$^2$ of drier surface, such as less than about 35 mg/m$^2$ or less than about 25 mg/m$^2$, or less than about 20 mg/m$^2$. Less than about 10 mg/m$^2$ is readily achieved if so desired. The creping adhesive add-on rate is calculated by dividing the rate of application of adhesive (mg/min) by surface area of the drying cylinder passing under the spray applicator boom (m$^2$/min). The resinous adhesive composition most preferably consists essentially of a polyvinyl alcohol resin and a polyamide-epichlorohydrin resin wherein the weight ratio of polyvinyl alcohol resin to polyamide-epichlorohydrin resin is from about 2 to about 4. By the terminology "consisting essentially of", it is meant that the adhesive composition contains less than 5% by weight modifier and more preferably less than about 2% by weight modifier.

Preferably, the furnish is predominantly SW pulp such as predominantly Douglas fir pulp. Optionally, the furnish comprises recycle pulp.

The papermaking fiber in the furnish may be at least 25%, 40% or 50% by weight Douglas Fir fiber and/or at least 25%, 40% or 50% by weight recycle fiber. A suitable composition includes, for example, pulp which is at least 25% by weight Douglas fir fiber and at least 25% by weight recycle fiber. In some cases more than 50% recycle fiber may be used, such as up to 75% by weight fiber of recycle fiber or 100% by weight fiber of recycle fiber.

Optionally, the process further comprises on-line calendering the web with a calender stack prior to winding the web on a roll, wherein the calender stack is synchronized with the reel prior to loading the calender stack. A calender loading of anywhere from 10-35 pli is suitable. Typically, the web is tensioned between the drying cylinder and the calender stack with a spreader bar or bow roll. The web also may be tensioned between the calender stack and the reel with an interposed spreader bar or roll.

In another aspect of the invention there is provided a method of making a fabric-creped absorbent cellulosic sheet with improved dispensing characteristics comprising: a) compactively dewatering a papermaking furnish to form a nascent web; b) applying the dewatered web to a translating transfer surface moving at a first speed; c) fabric-creping the web from the transfer surface at a consistency of from about 30 to about 60 percent utilizing a patterned creping fabric, the creping step occurring under pressure in a fabric creping nip defined between the transfer surface and the creping fabric wherein the fabric is traveling at a second speed slower than the speed of said transfer surface, the fabric pattern, nip parameters, velocity delta and web consistency being selected such that the web is creped from the transfer surface and transferred to the creping fabric; wherein the fabric crepe is from about 2% to about 15%; d) adhering the web to a drying cylinder with a resinous adhesive coating composition; e) drying the web on the drying cylinder; and f) peeling the web from the drying cylinder; wherein the furnish, creping fabric and creping adhesive are selected and the velocity delta, nip parameters and web consistency are controlled such that the web exhibits a WAR of less value of less than about 35 seconds.

In still another aspect of the invention, there is provided a method of making a fabric-creped absorbent cellulosic sheet with improved dispensing characteristics comprising: a) compactively dewatering a papermaking furnish to form a nascent web; b) applying the dewatered web to a translating transfer surface moving at a first speed; c) fabric-creping the web from the transfer surface at a consistency of from about 30 to about 60 percent utilizing a patterned creping fabric, the creping step occurring under pressure in a fabric creping nip defined between the transfer surface and the creping fabric wherein the fabric is traveling at a second speed slower than the speed of said transfer surface, the fabric pattern, nip parameters, velocity delta and web consistency being selected such that the web is creped from the transfer surface and transferred to the creping fabric; wherein the fabric crepe is from about 2 to about 15%; d) adhering the web to a drying cylinder with a resinous adhesive coating composition; e) drying the web on the drying cylinder; and f) peeling the web from the drying cylinder; wherein the furnish, creping fabric and creping adhesive are selected and the velocity delta, nip parameters and web consistency are controlled such that the absorbency of the web is at least about 3 g/g. Preferably, the web has an absorbency of at least about 3.5 g/g or at least about 4.5 g/g. In still another embodiment, the web has an absorbency of at least about 5 or 5.5 g/g.

Still another aspect of the invention is a method of making a fabric-creped absorbent cellulosic sheet with improved dispensing characteristics comprising: a) compactively dewatering a papermaking furnish to form a nascent web; b) applying the dewatered web to a translating transfer surface moving at a first speed; c) fabric-creping the web from the transfer surface at a consistency of from about 30 to about 60 percent utilizing a patterned creping fabric, the creping step occurring under pressure in a fabric creping nip defined between the transfer surface and the creping fabric wherein the fabric is traveling at a second speed slower than the speed of said transfer surface, the fabric pattern, nip parameters, velocity delta and web consistency being selected such that the web is creped from the transfer surface and transferred to the creping fabric; d) adhering the web to a drying cylinder with a resinous adhesive coating composition; e) drying the web on the drying cylinder; f) peeling the web from the drying cylinder; and g) stabilizing the web utilizing an airfoil with a rounded edge in proximity with the drying cylinder. The process may also include stabilizing the web over an open draw utilizing at least one additional air foil or at least two additional air foils to stabilize the web. In one preferred embodiment, the web is formed having an apparently random distribution of fiber orientation and creped such that the fiber is redistributed on the creping fabric with a different distribution of fiber orientation corresponding to that of the creping fabric.

In still further aspects of the invention, products with the attributes listed in Table 1 are provided. All or any number of the listed attributes may be embodied in a particular product of the invention. It will be appreciated from the discussion which follows that these attributes are achieved by selecting the furnish, creping fabric and creping adhesive and controlling the velocity delta, nip parameters and web consistency at various points in the process with consistency after peeling from the Yankee being particularly useful. Moisture content of 2½-5% (bone dry basis) upon peeling is preferred.

TABLE 1

| | Product Properties | | |
|---|---|---|---|
| Property | General | Typical | Preferred |
| Basis Weight lbs/3000 sq. ft. | 10-40 | 15-30 | 18-28 |
| MD Bending length (cm) | ≧3.5 | 3.5-5; 3.5-7; 3.5-10 | ≧3.75 |
| Caliper mils/ 8 sheet | 30-100 | 40-90 | 45-65 |
| CD wet/dry % | ≧20 | 22-35 | 23-26 |
| CD wet tensile (g/3") (Finch) | ≧500 | ≧750, ≧850; 600-1350 | 750-1200; 600-1350 |
| GM Break modulus g/3 in/% strain | 600-1200 | 700-1100 | — |
| MD Stretch % | ≧5; 5-20 | ≧6, ≧7; 5-15 | ≧8, ≧9, ≧10, ≧20; 5-8 |
| SAT (g/g) | ≧3 | ≧4, ≧4.5; 3-5.5 | 4-5.5 |
| WAR (seconds) | ≦35 | ≦30, ≦25 | ≦20 10-20 |

Most preferably, the product has no crepe bars which are due to dry creping and the product is supplied to consumers from an automatic dispenser in the form of a single-ply towel. Because the sheet had not been dry-creped, it has very low dusting as will be seen in the examples which follow.

In preferred embodiments, the sheet of the invention contains from about 8-16 lbs/ton of PAE wet strength resin and from about 2-6 lbs per ton of carboxymethyl cellulose dry strength resin. Optionally, 1 to 11 lbs. of polyacrylamide dry strength resin may be included. Less than about 17.5 lbs/ton of wet strength resin is preferred for higher absorbency.

BRIEF DESCRIPTION OF DRAWINGS

The invention is described in detail below with reference to the drawings wherein like numbers designate similar parts and wherein.

DETAILED DESCRIPTION

Figure 1:
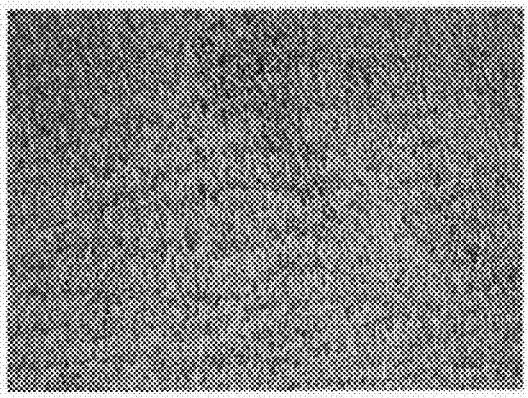
FIGS. 1-5 are photomicrographs of TAD sheets suitable for automatic towel dispensers.

The invention is described in detail below with reference to several embodiments and numerous examples. Such discussion is for purposes of illustration only. Modifications to particular examples within the spirit and scope of the present invention, set forth in the appended claims, will be readily apparent to one of skill in the art.

Terminology used herein is given its ordinary meaning consistent with the exemplary definitions set forth immediately below; mg refers to milligrams and $m^2$ refers to square meters and so forth. Unless otherwise specified, test specimens are prepared under standard TAPPI conditions, that is, conditioned in an atmosphere of 23°±1.0° C. (73.4°±1.8° F.) at 50% relative humidity for at least about 2 hours.

Throughout this specification and claims, when we refer to a nascent web having an apparently random distribution of fiber orientation (or use like terminology), we are referring to the distribution of fiber orientation that results when known forming techniques are used for depositing a furnish on the forming fabric. When examined microscopically, the fibers give the appearance of being randomly oriented even though, depending on the jet to wire speed, there may be a significant bias toward machine direction orientation making the machine direction tensile strength of the web exceed the cross-direction tensile strength.

Unless otherwise specified, "basis weight", BWT, bwt and so forth refers to the weight of a 3000 square foot ream of product. Consistency refers to percent solids of a nascent web, for example, calculated on a bone dry basis. "Air dry" means including residual moisture, by convention up to about 10 percent moisture for pulp and up to about 6% for paper. A nascent web having 50 percent water and 50 percent bone dry pulp has a consistency of 50 percent.

The term "cellulosic", "cellulosic sheet" and the like is meant to include any product incorporating papermaking fiber having cellulose as a major constituent. "Papermaking fibers" include virgin pulps or recycle (secondary) cellulosic fibers or fiber mixes comprising cellulosic fibers. Fibers suitable for making the webs of this invention include: nonwood fibers, such as cotton fibers or cotton derivatives, abaca, kenaf, sabai grass, flax, esparto grass, straw, jute hemp, bagasse, milkweed floss fibers, and pineapple leaf fibers; and wood fibers such as those obtained from deciduous and coniferous trees, including softwood fibers, such as northern and southern softwood kraft fibers; hardwood fibers, such as eucalyptus, maple, birch, aspen, or the like. Papermaking fibers can be liberated from their source material by any one of a number of chemical pulping processes familiar to one experienced in the art including sulfate, sulfite, polysulfide, soda pulping, etc. The pulp can be bleached if desired by chemical means including the use of chlorine, chlorine dioxide, oxygen, alkaline peroxide and so forth. The products of the present invention may comprise a blend of conventional fibers (whether derived from virgin pulp or recycle sources) and high coarseness lignin-rich tubular fibers, such as bleached chemical thermomechanical pulp (BCTMP). "Furnish" and like terminology refers to aqueous compositions including papermaking fibers, optionally wet strength resins, debonders and the like for making paper products.

Preferably, furnishes consist predominantly (more than 50% by weight of fiber) of softwood (SW) fiber such as Douglas fir. Southern Softwood Kraft (SSWK) is also a preferred fiber. In some embodiments large amounts of recycle fiber, which is typically predominantly hardwood (HW) fiber is used. Recycle fiber is in many cases 80% hardwood fiber.

As used herein, the term compactively dewatering the web or furnish refers to mechanical dewatering by wet pressing on a dewatering felt, for example, in some embodiments by use of mechanical pressure applied continuously over the web surface as in a nip between a press roll and a press shoe wherein the web is in contact with a papermaking felt. The terminology "compactively dewatering" is used to distinguish processes wherein the initial dewatering of the web is carried out largely by thermal means as is the case, for example, in U.S. Pat. No. 4,529,480 to Trokhan and U.S. Pat. No. 5,607,551 to Farrington et al. noted above. Compactively dewatering a web thus refers, for example, to removing water from a nascent web having a consistency of less than 30 percent or so by application of pressure thereto and/or increasing the consistency of the web by about 15 percent or more by application of pressure thereto; that is, for example, increasing the consistency of the web from 30 percent to 45 percent.

Creping fabric and like terminology refers to a fabric or belt which bears a pattern suitable for practicing the process of the present invention and preferably is permeable enough such that the web may be dried while it is held in the creping fabric. In cases where the web is transferred to another fabric or surface (other than the creping fabric) for drying, the creping fabric may have lower permeability.

"Fabric side" and like terminology refers to the side of the web which is in contact with the creping fabric. "Dryer side" or "Yankee side" is the side of the web in contact with the drying cylinder, typically opposite the fabric side of the web.

Fpm refers to feet per minute.

A "like" web produced by "like" means refers to a web made from substantially identical equipment in substantially the same way; that is with substantially the same overall crepe, fabric crepe, nip parameters and so forth.

MD means machine direction and CD means cross-machine direction.

Nip parameters include, without limitation, nip pressure, nip width, backing roll hardness, fabric approach angle, fabric takeaway angle, uniformity, nip penetration and velocity delta between surfaces of the nip.

Nip width means the MD length over which the nip surfaces are in contact.

"On line" and like terminology refers to a process step performed without removing the web from the papermachine in which the web is produced. A web is drawn or calendered on line when it is drawn or calendered without being severed prior to wind-up.

A translating transfer surface refers to the surface from which the web is creped into the creping fabric. The translating transfer surface may be the surface of a rotating drum as described hereafter, or may be the surface of a continuous smooth moving belt or another moving fabric which may have surface texture and so forth. The translating transfer surface needs to support the web and facilitate the high solids creping as will be appreciated from the discussion which follows.

Figure 25:
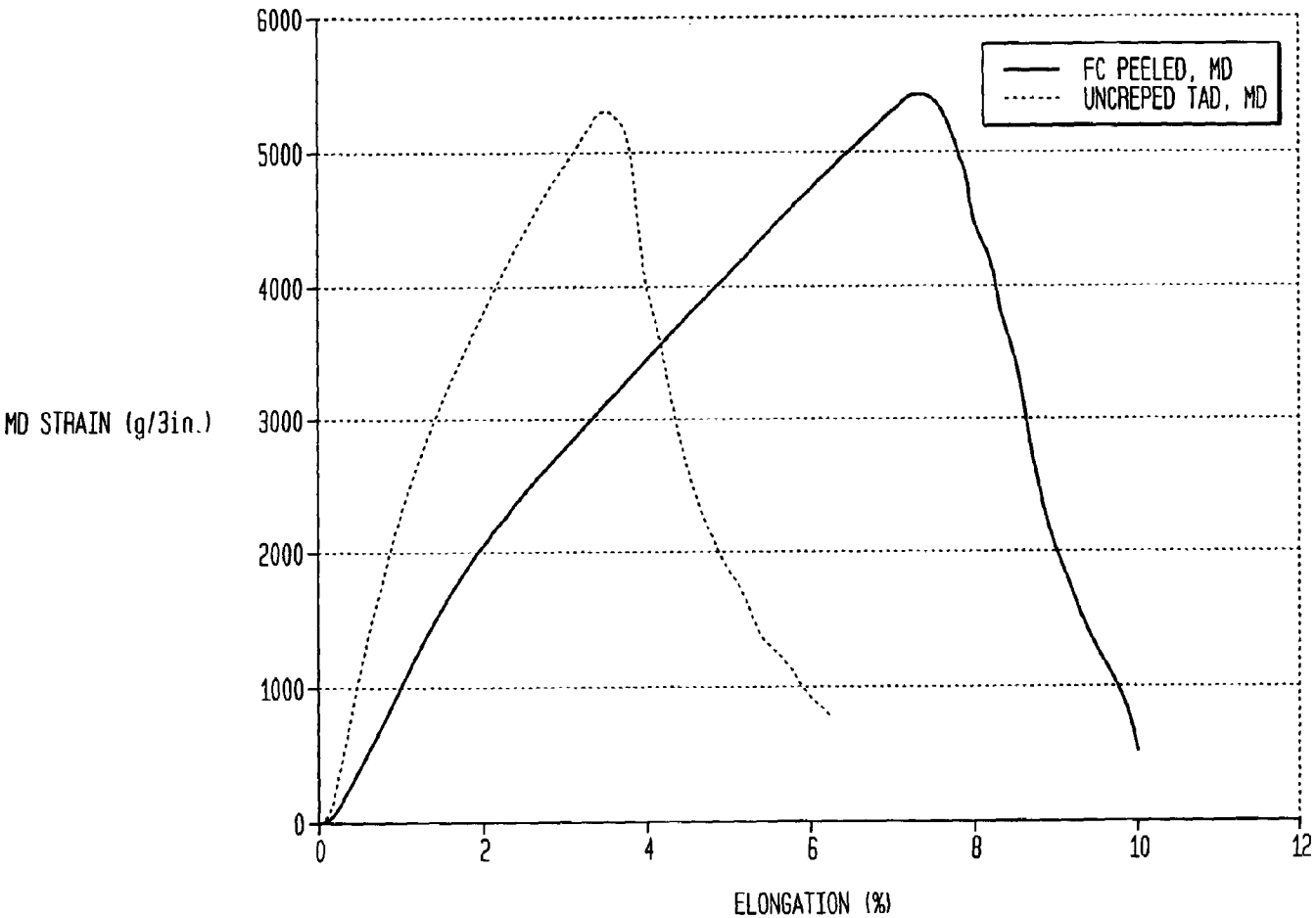

When we refer to uncreped throughdried products, we are not referring to products manufactured by way of a process involving numerous rush transfers between fabrics; rather we refer to products which are at least partially throughdried and further dried without creping. These products have relatively low MD stretch as is seen in FIG. 25 in particular. Typically, rush transfer is carried out using suction to assist in detaching the web from the donor fabric and thereafter attaching it to the receiving or receptor fabric. In contrast, suction is not required in a fabric creping step, so accordingly when we refer to fabric creping as being "under pressure" we are referring to loading of the receptor fabric against the transfer surface although suction assist can be employed at the expense of further complication of the system so long as the amount of suction is not sufficient to interfere with rearrangement or redistribution of the fiber.

Calipers and or bulk reported herein may be measured at 8 or 16 sheet calipers as specified. The sheets are stacked and the caliper measurement taken about the central portion of the stack. Preferably, the test samples are conditioned in an atmosphere of 23°±1.0° C. (73.4°±1.8° F.) at 50% relative humidity for at least about 2 hours and then measured with a Thwing-Albert Model 89-II-JR or Progage Electronic Thickness Tester with 2-in (50.8-mm) diameter anvils, 539±10 grams dead weight load, and 0.231 in./sec descent rate. For finished product testing, each sheet of product to be tested must have the same number of plies as the product as sold. For testing in general, eight sheets are selected and stacked together. For napkin testing, napkins are unfolded prior to stacking. For basesheet testing off of winders, each sheet to be tested must have the same number of plies as produced off the winder. For basesheet testing off of the papermachine reel, single plies must be used. Sheets are stacked together aligned in the MD. On custom embossed or printed product, try to avoid taking measurements in these areas if at all possible. Bulk may also be expressed in units of volume/weight by dividing caliper by basis weight.

MD bending length (cm) is determined in accordance with ASTM test method D 1388-96, cantilever option. Reported bending lengths refer to MD bending lengths unless a CD bending length is expressly specified. The MD bending length test was performed with a Cantilever Bending Tester available from Research Dimensions, 1720 Oakridge Road, Neenah, Wis., 54956 which is substantially the apparatus shown in the ASTM test method, item 6. The instrument is placed on a level stable surface, horizontal position being confirmed by a built in leveling bubble. The bend angle indicator is set at 41.5° below the level of the sample table. This is accomplished by setting the knife edge appropriately. The sample is cut with a one inch JD strip cutter available from Thwing-Albert Instrument Company, 14 Collins Avenue, W. Berlin, N.J. 08091. Six (6) samples are cut 1 inch×8 inch machine direction specimens. Samples are conditioned at 23° C.±1° C. (73.4° F.±1.8° F.) at 50% relative humidity for at least two hours. For machine direction specimens the longer dimension is parallel to the machine direction. The specimens should be flat, free of wrinkles, bends or tears. The Yankee side of the specimens is also labeled. The specimen is placed on the horizontal platform of the tester aligning the edge of the specimen with the right hand edge. The movable slide is placed on the specimen, being careful not to change its initial position. The right edge of the sample and the movable slide should be set at the right edge of the horizontal platform. The movable slide is displaced to the right in a smooth, slow manner at approximately 5 inch/minute until the specimen touches the knife edge. The overhang length is recorded to the nearest 0.1 cm. This is done by reading the left edge of the movable slide. Three specimens are preferably run with the Yankee side up and three specimens are preferably run with the Yankee side down on the horizontal platform. The MD bending length is reported as the average overhang length in centimeters divided by two to account for bending axis location. Bending length refers to MD bending length unless specified otherwise.

Absorbency of the inventive products is measured with a simple absorbency tester. The simple absorbency tester is a particularly useful apparatus for measuring the hydrophilicity and absorbency properties of a sample of tissue, napkins, or towel. In this test a sample of tissue, napkins, or towel 2.0 inches in diameter is mounted between a top flat plastic cover and a bottom grooved sample plate. The tissue, napkin, or towel sample disc is held in place by a ⅛ inch wide circumference flange area. The sample is not compressed by the holder. De-ionized water at 73° F. is introduced to the sample at the center of the bottom sample plate through a 1 mm. diameter conduit. This water is at a hydrostatic head of minus 5 mm. Flow is initiated by a pulse introduced at the start of the measurement by the instrument mechanism. Water is thus imbibed by the tissue, napkin, or towel sample from this central entrance point radially outward by capillary action. When the rate of water imbibation decreases below 0.005 gm water per 5 seconds, the test is terminated. The amount of water removed from the reservoir and absorbed by the sample is weighed and reported as grams of water per square meter of sample or grams of water per gram of sheet. In practice, an M/K Systems Inc. Gravimetric Absorbency Testing System is used. This is a commercial system obtainable from M/K Systems Inc., 12 Garden Street, Danvers, Mass., 01923. WAC or water absorbent capacity, also referred to as SAT, is actually determined by the instrument itself. WAC is defined as the point where the weight versus time graph has a "zero" slope, i.e., the sample has stopped absorbing. The termination criteria for a test are expressed in maximum change in water weight absorbed over a fixed time period. This is basically an estimate of zero slope on the weight versus time graph. The program uses a change of 0.005 g over a 5 second time interval as termination criteria; unless "Slow SAT" is specified in which case the cut off criteria is 1 mg in 20 seconds.

Water absorbency rate or WAR, is measured in seconds and is the time it takes for a sample to absorb a 0.1 gram droplet of water disposed on its surface by way of an automated syringe. The test specimens are preferably conditioned at 23° C.±1° C. (73.4±1.8° F.) at 50% relative humidity. For each sample, 4 3×3 inch test specimens are prepared. Each specimen is placed in a sample holder such that a high intensity lamp is directed toward the specimen. 0.1 ml of water is deposited on the specimen surface and a stop watch is started. When the water is absorbed, as indicated by lack of further reflection of light from the drop, the stopwatch is stopped and the time recorded to the nearest 0.1 seconds. The procedure is repeated for each specimen and the results averaged for the sample. WAR is measured in accordance with TAPPI method T-432 cm-99.

Dry tensile strengths (MD and CD), stretch, ratios thereof, modulus, break modulus, stress and strain are measured with a standard Instron test device or other suitable elongation tensile tester which may be configured in various ways, typically using 3 or 1 inch wide strips of tissue or towel, conditioned in an atmosphere of 23°±1° C. (73.4°±1° F.) at 50% relative humidity for 2 hours. The tensile test is run at a crosshead speed of 2 in/min. Tensile strength is sometimes referred to simply as "tensile".

GM Break Modulus is expressed in grams/3 inches/% strain. % strain is dimensionless and units need not be specified. Tensile values refer to break values unless otherwise indicated. Tensile strengths are reported in g/3" at break. GM Break Modulus is thus:

$$[(\text{MD tensile/MD Stretch at break})\times(\text{CD tensile/CD Stretch at break})]^{1/2}$$

Tensile ratios are simply ratios of the values determined by way of the foregoing methods. Unless otherwise specified, a tensile property is a dry sheet property.

The wet tensile of the tissue of the present invention is measured using a three-inch wide strip of tissue that is folded into a loop, clamped in a special fixture termed a Finch Cup, then immersed in a water. The Finch Cup, which is available from the Thwing-Albert Instrument Company of Philadelphia, Pa., is mounted onto a tensile tester equipped with a 2.0 pound load cell with the flange of the Finch Cup clamped by the tester's lower jaw and the ends of tissue loop clamped into the upper jaw of the tensile tester. The sample is immersed in water that has been adjusted to a pH of 7.0±0.1 and the tensile is tested after a 5 second immersion time. Values are divided by two, as appropriate, to account for the loop.

Wet/dry tensile ratios are expressed in percent by multiplying the ratio by 100.

"Fabric crepe ratio" is an expression of the speed differential between the creping fabric and the forming wire and typically calculated as the ratio of the web speed immediately before fabric creping and the web speed immediately following fabric creping, the forming wire and transfer surface being typically, but not necessarily, operated at the same speed:

$$\text{Fabric crepe ratio}=\text{transfer cylinder speed}\div\text{creping fabric speed}$$

Fabric crepe can also be expressed as a percentage calculated as:

$$\text{Fabric crepe, percent,}=[\text{Fabric crepe ratio}-1]\times 100\%$$

A web creped from a transfer cylinder with a surface speed of 750 fpm to a fabric with a velocity of 500 fpm has a fabric crepe ratio of 1.5 and a fabric crepe of 50%.

The total crepe ratio is calculated as the ratio of the forming wire speed to the reel speed and a % total crepe is:

$$\text{Total Crepe }\%=[\text{Total Crepe Ratio}-1]\times 100\%$$

A process with a forming wire speed of 2000 fpm and a reel speed of 1000 fpm has a line or total crepe ratio of 2 and a total crepe of 100%.

PLI or pli means pounds force per linear inch.

Pusey and Jones (P&J) hardness (indentation) is measured in accordance with ASTM D 531, and refers to the indentation number (standard specimen and conditions).

Velocity delta means a difference in linear speed.

A creping adhesive is optionally used to secure the web to the transfer cylinder and is used to adhere the fabric creped web to the Yankee before it is peeled as is hereinafter described. The adhesive is preferably a hygroscopic, re-wettable, substantially non-crosslinking adhesive. Examples of preferred adhesives are those which include poly(vinyl alcohol) of the general class described in U.S. Pat. No. 4,528,316 to Soerens et al. Other suitable adhesives are disclosed in co-pending U.S. Provisional Patent Application Ser. No. 60/372,255, filed Apr. 12, 2002, entitled "Improved Creping Adhesive Modifier and Process for Producing Paper Products". The disclosures of the '316 patent and the '255 application are incorporated herein by reference. Suitable adhesives are optionally provided with modifiers and so forth. It is preferred to use crosslinker and/or modifier sparingly or not at all in the adhesive.

Creping adhesives may comprise a thermosetting or non-thermosetting resin, a film-forming semi-crystalline polymer and optionally an inorganic cross-linking agent as well as modifiers. Optionally, the creping adhesive of the present invention may also include other components, including, but not limited to, hydrocarbons oils, surfactants, or plasticizers.

Creping modifiers which may be used in limited amounts include a quaternary ammonium complex comprising at least one non-cyclic amide. The quaternary ammonium complex may also contain one or several nitrogen atoms (or other atoms) that are capable of reacting with alkylating or quaternizing agents. These alkylating or quaternizing agents may contain zero, one, two, three or four non-cyclic amide containing groups. An amide containing group is represented by the following formula structure:

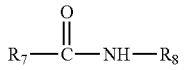

where $R_7$ and $R_8$ are non-cyclic molecular chains of organic or inorganic atoms.

Preferred non-cyclic bis-amide quaternary ammonium complexes can be of the formula:

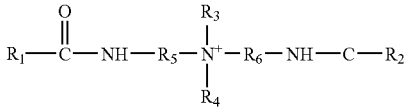

where $R_1$ and $R_2$ can be long chain non-cyclic saturated or unsaturated aliphatic groups; $R_3$ and $R_4$ can be long chain non-cyclic saturated or unsaturated aliphatic groups, a halogen, a hydroxide, an alkoxylated fatty acid, an alkoxylated fatty alcohol, a polyethylene oxide group, or an organic alcohol group; and $R_5$ and $R_6$ can be long chain non-cyclic saturated or unsaturated aliphatic groups. The modifier is optionally present in the creping adhesive in an amount of from about 0.05% to about 25%, more preferably from about 0.25% to about 10%, and most preferably from about 0.5% to about 5% based on the total solids of the creping adhesive composition.

Modifiers include those obtainable from Goldschmidt Corporation of Essen/Germany or Process Application Corporation based in Washington Crossing, Pa. Appropriate creping modifiers from Goldschmidt Corporation include, but are not limited to, VARISOFT® 222LM, VARISOFT® 222, VARISOFT® 110, VARISOFT® 222LT, VARISOFT® 110 DEG, and VARISOFT® 238. Appropriate creping modifiers from Process Application Corporation include, but are not limited to, PALSOFT 580 FDA or PALSOFT 580C.

Other creping modifiers for use in the present invention include, but are not limited to, those compounds as described in WO/01/85109, which is incorporated herein by reference in its entirety.

Creping adhesives for use in connection with to the present invention may include any suitable thermosetting or non-thermosetting resin. Resins according to the present invention are preferably chosen from thermosetting and non-thermosetting polyamide resins or glyoxylated polyacrylamide resins. Polyamides for use in the present invention can be branched or unbranched, saturated or unsaturated.

Polyamide resins for use in the present invention may include polyaminoamide-epichlorohydrin (PAE) resins of the same general type employed as wet strength resins. PAE resins are described, for example, in "Wet-Strength Resins and Their Applications," Ch. 2, H. Epsy entitled *Alkaline-Curing Polymeric Amine-Epichlorohydrin Resins*, which is incorporated herein by reference in its entirety. Preferred PAE resins for use according to the present invention include a water-soluble polymeric reaction product of an epihalohydrin, preferably epichlorohydrin, and a water-soluble polyamide having secondary amine groups derived from a polyalkylene polyamine and a saturated aliphatic dibasic carboxylic acid containing from about 3 to about 10 carbon atoms.

A non-exhaustive list of non-thermosetting cationic polyamide resins can be found in U.S. Pat. No. 5,338,807, issued to Espy et al. and incorporated herein by reference. The non-thermosetting resin may be synthesized by directly reacting the polyamides of a dicarboxylic acid and methyl bis(3-aminopropyl)amine in an aqueous solution, with epichlorohydrin. The carboxylic acids can include saturated and unsaturated dicarboxylic acids having from about 2 to 12 carbon atoms, including for example, oxalic, malonic, succinic, glutaric, adipic, pilemic, suberic, azelaic, sebacic, maleic, itaconic, phthalic, and terephthalic acids. Adipic and glutaric acids are preferred, with adipic acid being the most preferred. The esters of the aliphatic dicarboxylic acids and aromatic dicarboxylic acids, such as the phathalic acid, may be used, as well as combinations of such dicarboxylic acids or esters. The preparation of water soluble, thermosetting polyamide-epihalohydrin resin is described in U.S. Pat. Nos. 2,926,116; 3,058,873; and 3,772,076 issued to Kiem, all of which are incorporated herein by reference in their entirety.

The polyamide resin may be based on DETA (diethylene triamine) instead of a generalized polyamine. Two examples of structures of such a polyamide resin are given below. Structure 1 shows two types of end groups: a di-acid and a mono-acid based group:

STRUCTURE 1

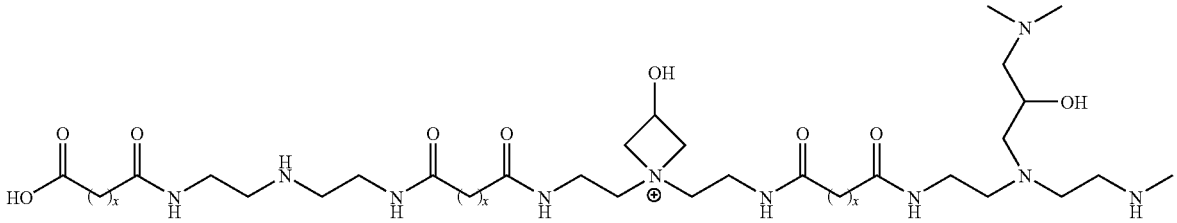

-continued

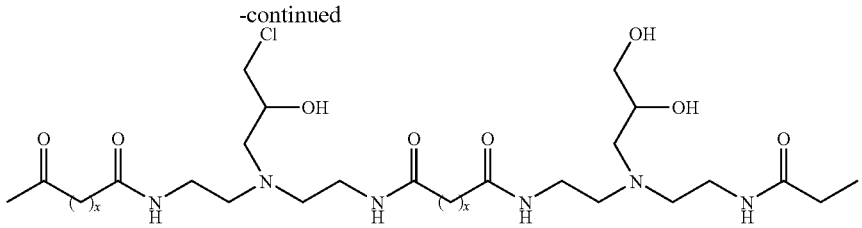

Structure 2 shows a polymer with one end-group based on a di-acid group and the other end-group based on a nitrogen group:

STRUCTURE 2

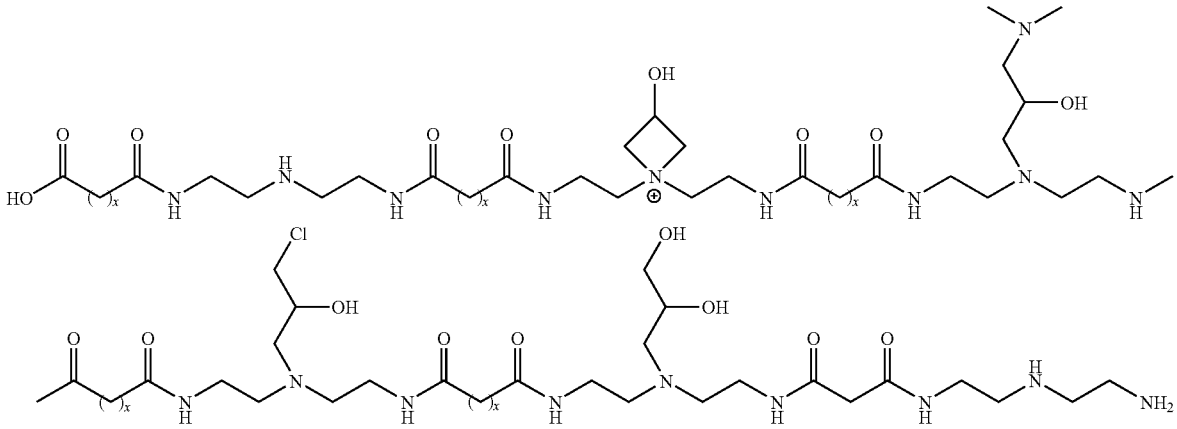

Note that although both structures are based on DETA, other polyamines may be used to form this polymer, including those, which may have tertiary amide side chains.

The polyamide resin has a viscosity of from about 80 to about 800 centipoise and a total solids of from about 5% to about 40%. The polyamide resin is present in the creping adhesive according to the present invention in an amount of from about 0% to about 99.5%. According to another embodiment, the polyamide resin is present in the creping adhesive in an amount of from about 20% to about 80%. In yet another embodiment, the polyamide resin is present in the creping adhesive in an amount of from about 40% to about 60% based on the total solids of the creping adhesive composition.

Polyamide resins for use according to the present invention can be obtained from Ondeo-Nalco Corporation, based in Naperville, Ill., and Hercules Corporation, based in Wilmington, Del. Creping adhesive resins for use according to the present invention from Ondeo-Nalco Corporation include, but are not limited to, CREPECCEL® 675NT, CREPECCEL® 675P and CREPECCEL® 690HA. Appropriate creping adhesive resins available from Hercules Corporation include, but are not limited to, HERCULES 82-176, HERCULES 1145, Unisoft 805 and CREPETROL A-6115. Other polyamide resins for use according to the present invention include, for example, those described in U.S. Pat. Nos. 5,961,782 and 6,133,405, both of which are incorporated herein by reference.

The creping adhesive also includes a film-forming semi-crystalline polymer. Film-forming semi-crystalline polymers for use in the present invention can be selected from, for example, hemicellulose, carboxymethyl cellulose, and most preferably includes polyvinyl alcohol (PVOH). Polyvinyl alcohols used in the creping adhesive can have an average molecular weight of about 13,000 to about 124,000 daltons. According to one embodiment, the polyvinyl alcohols have a degree of hydrolysis of from about 80% to about 99.9%. According to another embodiment, polyvinyl alcohols have a degree of hydrolysis of from about 85% to about 95%. In yet another embodiment, polyvinyl alcohols have a degrees of hydrolysis of from about 86% to about 90%. Also, according to one embodiment, polyvinyl alcohols preferably have a viscosity, measured at 20 degree centigrade using a 4% aqueous solution, of from about 2 to about 100 centipoise. According to another embodiment, polyvinyl alcohols have a viscosity of from about 10 to about 70 centipoise. In yet another embodiment, polyvinyl alcohols have a viscosity of from about 20 to about 50 centipoise.

Typically, the polyvinyl alcohol is present in the creping adhesive in an amount of from about 10% to 90% or 20% to about 80% or more. In some embodiments, the polyvinyl alcohol is present in the creping adhesive in an amount of from about 40% to about 60%, by weight, based on the total solids of the creping adhesive composition.

Polyvinyl alcohols for use according to the present invention include those obtainable from Monsanto Chemical Co. and Celanese Chemical. Appropriate polyvinyl alcohols from Monsanto Chemical Co. include Gelvatols, including, but not limited to, GELVATOL 1-90, GELVATOL 3-60, GELVATOL 20-30, GELVATOL 1-30, GELVATOL 20-90, and GELVATOL 20-60. Regarding the Gelvatols, the first number indicates the percentage residual polyvinyl acetate and the next series of digits when multiplied by 1,000 gives the number corresponding to the average molecular weight.

Celanese Chemical polyvinyl alcohol products for use in the creping adhesive (previously named Airvol products from Air Products until October 2000) are listed below:

TABLE 2

Polyvinyl Alcohol for Creping Adhesive

| Grade | % Hydrolysis, | Viscosity, cps[1] | pH | Volatiles, % Max. | Ash, % Max. |
|---|---|---|---|---|---|
| | | Super Hydrolyzed | | | |
| Celvol 125 | 99.3+ | 28-32 | 5.5-7.5 | 5 | 1.2 |
| Celvol 165 | 99.3+ | 62-72 | 5.5-7.5 | 5 | 1.2 |
| | | Fully Hydrolyzed | | | |
| Celvol 103 | 98.0-98.8 | 3.5-4.5 | 5.0-7.0 | 5 | 1.2 |
| Celvol 305 | 98.0-98.8 | 4.5-5.5 | 5.0-7.0 | 5 | 1.2 |
| Celvol 107 | 98.0-98.8 | 5.5-6.6 | 5.0-7.0 | 5 | 1.2 |
| Celvol 310 | 98.0-98.8 | 9.0-11.0 | 5.0-7.0 | 5 | 1.2 |
| Celvol 325 | 98.0-98.8 | 28.0-32.0 | 5.0-7.0 | 5 | 1.2 |
| Celvol 350 | 98.0-98.8 | 62-72 | 5.0-7.0 | 5 | 1.2 |
| | | Intermediate Hydrolyzed | | | |
| Celvol 418 | 91.0-93.0 | 14.5-19.5 | 4.5-7.0 | 5 | 0.9 |
| Celvol 425 | 95.5-96.5 | 27-31 | 4.5-6.5 | 5 | 0.9 |
| | | Partially Hydrolyzed | | | |
| Celvol 502 | 87.0-89.0 | 3.0-3.7 | 4.5-6.5 | 5 | 0.9 |
| Celvol 203 | 87.0-89.0 | 3.5-4.5 | 4.5-6.5 | 5 | 0.9 |
| Celvol 205 | 87.0-89.0 | 5.2-6.2 | 4.5-6.5 | 5 | 0.7 |
| Celvol 513 | 86.0-89.0 | 13-15 | 4.5-6.5 | 5 | 0.7 |
| Celvol 523 | 87.0-89.0 | 23-27 | 4.0-6.0 | 5 | 0.5 |
| Celvol 540 | 87.0-89.0 | 45-55 | 4.0-6.0 | 5 | 0.5 |

[1]4% aqueous solution, 20° C.

The creping adhesive may also comprise one or more inorganic cross-linking salts or agents. Such additives are believed best used sparingly or not at all in connection with the present invention. A non-exhaustive list of multivalent metal ions includes calcium, barium, titanium, chromium, manganese, iron, cobalt, nickel, zinc, molybdenum, tin, antimony, niobium, vanadium, tungsten, selenium, and zirconium. Mixtures of metal ions can be used. Preferred anions include acetate, formate, hydroxide, carbonate, chloride, bromide, iodide, sulfate, tartrate, and phosphate. An example of a preferred inorganic cross-linking salt is a zirconium salt. The zirconium salt for use according to one embodiment of the present invention can be chosen from one or more zirconium compounds having a valence of plus four, such as ammonium zirconium carbonate, zirconium acetylacetonate, zirconium acetate, zirconium carbonate, zirconium sulfate, zirconium phosphate, potassium zirconium carbonate, zirconium sodium phosphate, and sodium zirconium tartrate. Appropriate zirconium compounds include, for example, those described in U.S. Pat. No. 6,207,011, which is incorporated herein by reference.

The inorganic cross-linking salt can be present in the creping adhesive in an amount of from about 0% to about 30%. In another embodiment, the inorganic cross-linking agent can be present in the creping adhesive in an amount of from about 1% to about 20%. In yet another embodiment, the inorganic cross-linking salt can be present in the creping adhesive in an amount of from about 1% to about 10% by weight based on the total solids of the creping adhesive composition. Zirconium compounds for use according to the present invention include those obtainable from EKA Chemicals Co. (previously Hopton Industries) and Magnesium Elektron, Inc. Appropriate commercial zirconium compounds from EKA Chemicals Co. are AZCOTE 5800M and KZCOTE 5000 and from Magnesium Elektron, Inc. are AZC or KZC.

As noted above, the creping adhesive can include any other components, including, but not limited to, organic cross-linkers, hydrocarbon oils, surfactants, amphoterics, humectants, plasticizers, or other surface treatment agents. An extensive, but non-exhaustive, list of organic cross-linkers includes glyoxal, maleic anhydride, bismaleimide, bis acrylamide, and epihalohydrin. The organic cross-linkers can be cyclic or non-cyclic compounds. Plastizers for use in the present invention can include propylene glycol, diethylene glycol, triethylene glycol, dipropylene glycol, and glycerol.

The creping adhesive may be applied as a single composition or may be applied in its component parts. More particularly, the polyamide resin may be applied separately from the polyvinyl alcohol (PVOH) and the modifier.

When using a creping blade, a normal coating package is applied at a total coating rate (add on as calculated above) of 54 mg/m$^2$ with 32 mg/m$^2$ of PVOH (Celvol 523)/11.3 mg/m$^2$ of PAE (Hercules 1145) and 10.5 mg/m$^2$ of modifier (Hercules 4609VF). A preferred coating for the peeling process of the invention is applied at a rate of 20 mg/m$^2$ with 14.52 mg/m$^2$ of PVOH (Celvol 523)/5.10 mg/m$^2$ of PAE (Hercules 1145) and 0.38 mg/m$^2$ of modifier (Hercules 4609VF).

According to the present invention, an absorbent paper web is made by dispersing papermaking fibers into aqueous furnish (slurry) and depositing the aqueous furnish onto the forming wire of a papermaking machine. Any suitable forming scheme might be used. For example, an extensive but non-exhaustive list in addition to Fourdrinier formers includes a crescent former, a C-wrap twin wire former, an S-wrap twin wire former, or a suction breast roll former. The forming fabric can be any suitable foraminous member including single layer fabrics, double layer fabrics, triple layer fabrics, photopolymer fabrics, and the like. Non-exhaustive background art in the forming fabric area includes U.S. Pat. Nos. 4,157,276; 4,605,585; 4,161,195; 3,545,705; 3,549,742; 3,858,623; 4,041,989; 4,071,050; 4,112,982; 4,149,571; 4,182,381; 4,184,519; 4,314,589; 4,359,069; 4,376,455; 4,379,735; 4,453,573; 4,564,052; 4,592,395; 4,611,639; 4,640,741; 4,709,732; 4,759,391; 4,759,976; 4,942,077; 4,967,085; 4,998,568; 5,016,678; 5,054,525; 5,066,532; 5,098,519; 5,103,874; 5,114,777; 5,167,261; 5,199,261; 5,199,467; 5,211,815; 5,219,004; 5,245,025; 5,277,761; 5,328,565; and 5,379,808 all of which are incorporated herein by reference in their entirety. One forming fabric particularly useful with the present invention is Voith Fabrics Forming Fabric 2164 made by Voith Fabrics Corporation, Shreveport, La.

Foam-forming of the aqueous furnish on a forming wire or fabric may be employed as a means for controlling the permeability or void volume of the sheet upon fabric-creping. Foam-forming techniques are disclosed in U.S. Pat. No. 4,543,156 and Canadian Patent No. 2,053,505, the disclosures of which are incorporated herein by reference. The foamed fiber furnish is made up from an aqueous slurry of fibers mixed with a foamed liquid carrier just prior to its introduction to the headbox. The pulp slurry supplied to the system has a consistency in the range of from about 0.5 to about 7 weight percent fibers, preferably in the range of from about 2.5 to about 4.5 weight percent. The pulp slurry is added to a foamed liquid comprising water, air and surfactant containing 50 to 80 percent air by volume forming a foamed fiber furnish having a consistency in the range of from about 0.1 to about 3 weight percent fiber by simple mixing from natural turbulence and mixing inherent in the process elements. The addition of the pulp as a low consistency slurry results in excess foamed liquid recovered from the forming wires. The excess foamed liquid is discharged from the system and may be used elsewhere or treated for recovery of surfactant therefrom.

The furnish may contain chemical additives to alter the physical properties of the paper produced. These chemistries are well understood by the skilled artisan and may be used in any known combination. Such additives may be surface modifiers, softeners, debonders, strength aids, latexes, opacifiers, optical brighteners, dyes, pigments, sizing agents, barrier chemicals, retention aids, insolubilizers, organic or inorganic crosslinkers, or combinations thereof; said chemicals optionally comprising polyols, starches, PPG esters, PEG esters, phospholipids, surfactants, polyamines, HMCP (Hydrophobically Modified Cationic Polymers), HMAP (Hydrophobically Modified Anionic Polymers) or the like.

The pulp can be mixed with strength adjusting agents such as wet strength agents, dry strength agents and debonders/softeners and so forth. Suitable wet strength agents are known to the skilled artisan. A comprehensive but non-exhaustive list of useful strength aids include urea-formaldehyde resins, melamine formaldehyde resins, glyoxylated polyacrylamide resins, polyamide-epichlorohydrin resins and the like. Thermosetting polyacrylamides are produced by reacting acrylamide with diallyl dimethyl ammonium chloride (DADMAC) to produce a cationic polyacrylamide copolymer which is ultimately reacted with glyoxal to produce a cationic cross-linking wet strength resin, glyoxylated polyacrylamide. These materials are generally described in U.S. Pat. Nos. 3,556,932 to Coscia et al. and 3,556,933 to Williams et al., both of which are incorporated herein by reference in their entirety. Resins of this type are commercially available under the trade name of PAREZ 63 INC by Bayer Corporation. Different mole ratios of acrylamide/-DADMAC/glyoxal can be used to produce cross-linking resins, which are useful as wet strength agents. Furthermore, other dialdehydes can be substituted for glyoxal to produce thermosetting wet strength characteristics. Of particular utility are the polyamide-epichlorohydrin wet strength resins, an example of which is sold under the trade names Kymene 557LX and Kymene 557H by Hercules Incorporated of Wilmington, Del. and Amres® from Georgia-Pacific Resins, Inc. These resins and the process for making the resins are described in U.S. Pat. No. 3,700,623 and U.S. Pat. No. 3,772,076 each of which is incorporated herein by reference in its entirety. An extensive description of polymeric-epihalohydrin resins is given in Chapter 2*: Alkaline-Curing Polymeric Amine-Epichlorohydrin* by Espy in Wet Strength Resins and Their Application (L. Chan, Editor, 1994), herein incorporated by reference in its entirety. A reasonably comprehensive list of wet strength resins is described by Westfelt in *Cellulose Chemistry and Technology* Volume 13, p. 813, 1979, which is incorporated herein by reference.

Suitable temporary wet strength agents may likewise be included, particularly in special applications where disposable towel with permanent wet strength resin is to be avoided. A comprehensive but non-exhaustive list of useful temporary wet strength agents includes aliphatic and aromatic aldehydes including glyoxal, malonic dialdehyde, succinic dialdehyde, glutaraldehyde and dialdehyde starches, as well as substituted or reacted starches, disaccharides, polysaccharides, chitosan, or other reacted polymeric reaction products of monomers or polymers having aldehyde groups, and optionally, nitrogen groups. Representative nitrogen containing polymers, which can suitably be reacted with the aldehyde containing monomers or polymers, includes vinyl-amides, acrylamides and related nitrogen containing polymers. These polymers impart a positive charge to the aldehyde containing reaction product. In addition, other commercially available temporary wet strength agents such as PAREZ 745, manufactured by Bayer, can be used, along with those disclosed, for example, in U.S. Pat. No. 4,605,702.

The temporary wet strength resin may be any one of a variety of water-soluble organic polymers comprising aldehydic units and cationic units used to increase dry and wet tensile strength of a paper product. Such resins are described in U.S. Pat. Nos. 4,675,394; 5,240,562; 5,138,002; 5,085,736; 4,981,557; 5,008,344; 4,603,176; 4,983,748; 4,866,151; 4,804,769 and 5,217,576. Modified starches sold under the trademarks CO-BOND® 1000 and CO-BOND® 1000 Plus by National Starch and Chemical Company of Bridgewater, N.J. may be used. Prior to use, the cationic aldehydic water soluble polymer can be prepared by preheating an aqueous slurry of approximately 5% solids maintained at a temperature of approximately 240 degrees Fahrenheit and a pH of about 2.7 for approximately 3.5 minutes. Finally, the slurry can be quenched and diluted by adding water to produce a mixture of approximately 1.0% solids at less than about 130 degrees Fahrenheit.

Other temporary wet strength agents, also available from National Starch and Chemical Company are sold under the trademarks CO-BOND® 1600 and CO-BOND® 2300. These starches are supplied as aqueous colloidal dispersions and do not require preheating prior to use.

Temporary wet strength agents such as glyoxylated polyacrylamide can be used. Temporary wet strength agents such glyoxylated polyacrylamide resins are produced by reacting acrylamide with diallyl dimethyl ammonium chloride (DADMAC) to produce a cationic polyacrylamide copolymer which is ultimately reacted with glyoxal to produce a cationic cross-linking temporary or semi-permanent wet strength resin, glyoxylated polyacrylamide. These materials are generally described in U.S. Pat. No. 3,556,932 to Coscia et al. and U.S. Pat. No. 3,556,933 to Williams et al., both of which are incorporated herein by reference. Resins of this type are commercially available under the trade name of PAREZ 63 INC, by Bayer Industries. Different mole ratios of acrylamide/DADMAC/glyoxal can be used to produce cross-linking resins, which are useful as wet strength agents. Furthermore, other dialdehydes can be substituted for glyoxal to produce wet strength characteristics.

Suitable dry strength agents include starch, guar gum, polyacrylamides, carboxymethyl cellulose and the like. Of particular utility is carboxymethyl cellulose, an example of which is sold under the trade name Hercules CMC, by Hercules Incorporated of Wilmington, Del. According to one embodiment, the pulp may contain from about 0 to about 15 lb/ton of dry strength agent. According to another embodiment, the pulp may contain from about 1 to about 5 lbs/ton of dry strength agent.

Suitable debonders are likewise known to the skilled artisan. Debonders or softeners may also be incorporated into the pulp or sprayed upon the web after its formation. The present invention may also be used with softener materials including but not limited to the class of amido amine salts derived from partially acid neutralized amines. Such materials are disclosed in U.S. Pat. No. 4,720,383. Evans, *Chemistry and Industry,* 5 Jul. 1969, pp. 893-903; Egan, *J. Am. Oil Chemist's Soc.*, Vol. 55 (1978), pp. 118-121; and Trivedi et al., *J. Am. Oil Chemist's Soc.*, June 1981, pp. 754-756, incorporated by reference in their entirety, indicate that softeners are often available commercially only as complex mixtures rather than as single compounds. While the following discussion will focus on the predominant species, it should be understood that commercially available mixtures would generally be used in practice.

Quasoft 202-JR is a suitable softener material, which may be derived by alkylating a condensation product of oleic acid and diethylenetriamine. Synthesis conditions using a deficiency of alkylation agent (e.g., diethyl sulfate) and only one alkylating step, followed by pH adjustment to protonate the non-ethylated species, result in a mixture consisting of cationic ethylated and cationic non-ethylated species. A minor proportion (e.g., about 10%) of the resulting amido amine cyclize to imidazoline compounds. Since only the imidazoline portions of these materials are quaternary ammonium compounds, the compositions as a whole are pH-sensitive. Therefore, in the practice of the present invention with this class of chemicals, the pH in the head box should be approximately 6 to 8, more preferably 6 to 7 and most preferably 6.5 to 7.

Quaternary ammonium compounds, such as dialkyl dimethyl quaternary ammonium salts are also suitable particularly when the alkyl groups contain from about 10 to 24 carbon atoms. These compounds have the advantage of being relatively insensitive to pH.

Biodegradable softeners can be utilized. Representative biodegradable cationic softeners/debonders are disclosed in U.S. Pat. Nos. 5,312,522; 5,415,737; 5,262,007; 5,264,082; and 5,223,096, all of which are incorporated herein by reference in their entirety. The compounds are biodegradable diesters of quaternary ammonia compounds, quaternized amine-esters, and biodegradable vegetable oil based esters functional with quaternary ammonium chloride and diester dierucyldimethyl ammonium chloride and are representative biodegradable softeners.

In some embodiments, a particularly preferred debonder composition includes a quaternary amine component as well as a nonionic surfactant.

The nascent web is typically dewatered on a papermaking felt. Any suitable felt may be used. For example, felts can have double-layer base weaves, triple-layer base weaves, or laminated base weaves. Preferred felts are those having the laminated base weave design. A wet-press-felt which may be particularly useful with the present invention is Vector 3 made by Voith Fabric. Background art in the press felt area includes U.S. Pat. Nos. 5,657,797; 5,368,696; 4,973,512; 5,023,132; 5,225,269; 5,182,164; 5,372,876; and 5,618,612. A differential pressing felt as is disclosed in U.S. Pat. No. 4,533,437 to Curran et al. may likewise be utilized.

Suitable creping or textured fabrics include single layer or multi-layer, or composite preferably open meshed structures. Fabric construction per se is of less importance than the topography of the creping surface in the creping nip as discussed in more detail below. Long MD knuckles with slightly lowered CD knuckles are greatly preferred for some products. Fabrics may have at least one of the following characteristics: (1) on the side of the creping fabric that is in contact with the wet web (the "top" side), the number of machine direction (MD) strands per inch (mesh) is from 10 to 200 and the number of cross-direction (CD) strands per inch (count) is also from 10 to 200; (2) the strand diameter is typically smaller than 0.050 inch; (3) on the top side, the distance between the highest point of the MD knuckles and the highest point on the CD knuckles is from about 0.001 to about 0.02 or 0.03 inch; (4) in between these two levels there can be knuckles formed either by MD or CD strands that give the topography a three dimensional hill/valley appearance which is imparted to the sheet; (5) the fabric may be oriented in any suitable way so as to achieve the desired effect on processing and on properties in the product; the long warp knuckles may be on the top side to increase MD ridges in the product, or the long shute knuckles may be on the top side if more CD ridges are desired to influence creping characteristics as the web is transferred from the transfer cylinder to the creping fabric; and (6) the fabric may be made to show certain geometric patterns that are pleasing to the eye, which is typically repeated between every two to 50 warp yarns. One preferred fabric is a W013 Albany International multilayer fabric. Such fabrics are formed from monofilament polymeric fibers having diameters typically ranging from about 0.25 mm to about 1 mm. Such fabrics are formed from monofilament polymeric fibers having diameters typically ranging from about 10 mm to about 100 mm. This fabric may be used to produce an absorbent cellulosic sheet having variable local basis weight comprising a papermaking fiber reticulum provided with (i) a plurality of cross-machine direction (CD) extending, fiber-enriched pileated regions of relatively high local basis weight interconnected by (ii) a plurality of elongated densified regions of compressed papermaking fibers, the elongated densified regions having relatively low local basis weight and are generally oriented along the machine direction (MD) of the sheet. The elongated densified regions are further characterized by an MD/CD aspect ratio of at least 1.5. Typically, the MD/CD aspect ratios of the densified regions are greater than 2 or greater than 3; generally between about 2 and 10. In most cases the fiber-enriched, pileated regions have fiber orientation bias along the CD of the sheet and the densified regions of relatively low basis weight extend in the machine direction and also have fiber orientation bias along the CD of the sheet. This product is further described in copending application U.S. Application Ser. No. 60/808,863, entitled "Fabric Creped Absorbent Sheet with Variable Local Basis Weight", filed May 26, 2006, the disclosure of which is incorporated herein in its entirety by reference.

The creping fabric may be of the class described in U.S. Pat. No. 5,607,551 to Farrington et al., Cols. 7-8 thereof, as well as the fabrics described in U.S. Pat. No. 4,239,065 to Trokhan and U.S. Pat. No. 3,974,025 to Ayers. Such fabrics may have about 20 to about 60 meshes per inch and are formed from monofilament polymeric fibers having diameters typically ranging from about 0.008 to about 0.025 inches. Both warp and weft monofilaments may, but need not necessarily be of the same diameter.

In some cases the filaments are so woven and complimentarily serpentinely configured in at least the Z-direction (the thickness of the fabric) to provide a first grouping or array of coplanar top-surface-plane crossovers of both sets of filaments; and a predetermined second grouping or array of sub-top-surface crossovers. The arrays are interspersed so that portions of the top-surface-plane crossovers define an array of wicker-basket-like cavities in the top surface of the fabric which cavities are disposed in staggered relation in both the machine direction (MD) and the cross-machine direction (CD), and so that each cavity spans at least one sub-top-surface crossover. The cavities are discretely perimetrically enclosed in the plan view by a picket-like-lineament comprising portions of a plurality of the top-surface plane crossovers. The loop of fabric may comprise heat set monofilaments of thermoplastic material; the top surfaces of the coplanar top-surface-plane crossovers may be monoplanar flat surfaces. Specific embodiments of the invention include satin weaves as well as hybrid weaves of three or greater sheds, and mesh counts of from about 10×10 to about 120×120 filaments per inch (4×4 to about 47×47 per centimeter). Although the preferred range of mesh counts is from about 18 by 16 to about 55 by 48 filaments per inch (9×8 to about 22×19 per centimeter).

Instead of an impression fabric, a dryer fabric may be used as the creping fabric if so desired. Suitable fabrics are described in U.S. Pat. Nos. 5,449,026 (woven style) and 5,690,149 (stacked MD tape yarn style) to Lee as well as U.S. Pat. No. 4,490,925 to Smith (spiral style).

If a Fourdrinier former or other gap former is used, the nascent web may be conditioned with suction boxes and a steam shroud until it reaches a solids content suitable for transferring to a dewatering felt. The nascent web may be transferred with suction assistance to the felt. In a crescent former, use of suction assist is unnecessary as the nascent web is formed between the forming fabric and the felt.

Figure 2:
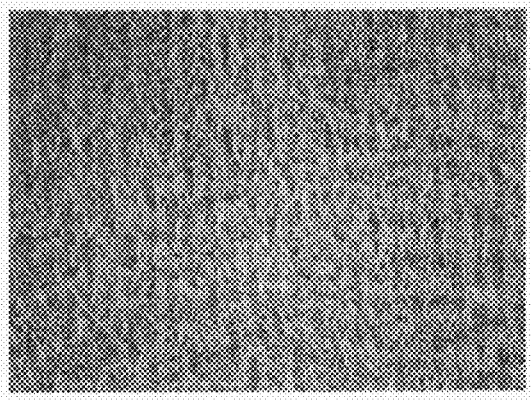
Figure 3:
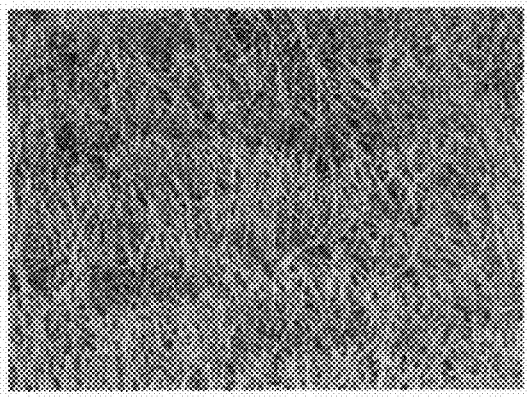
Figure 4:
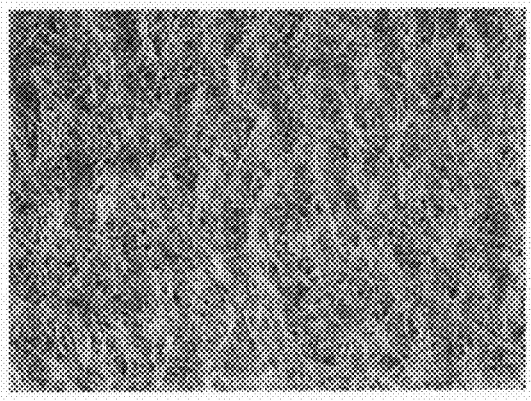
Figure 5:
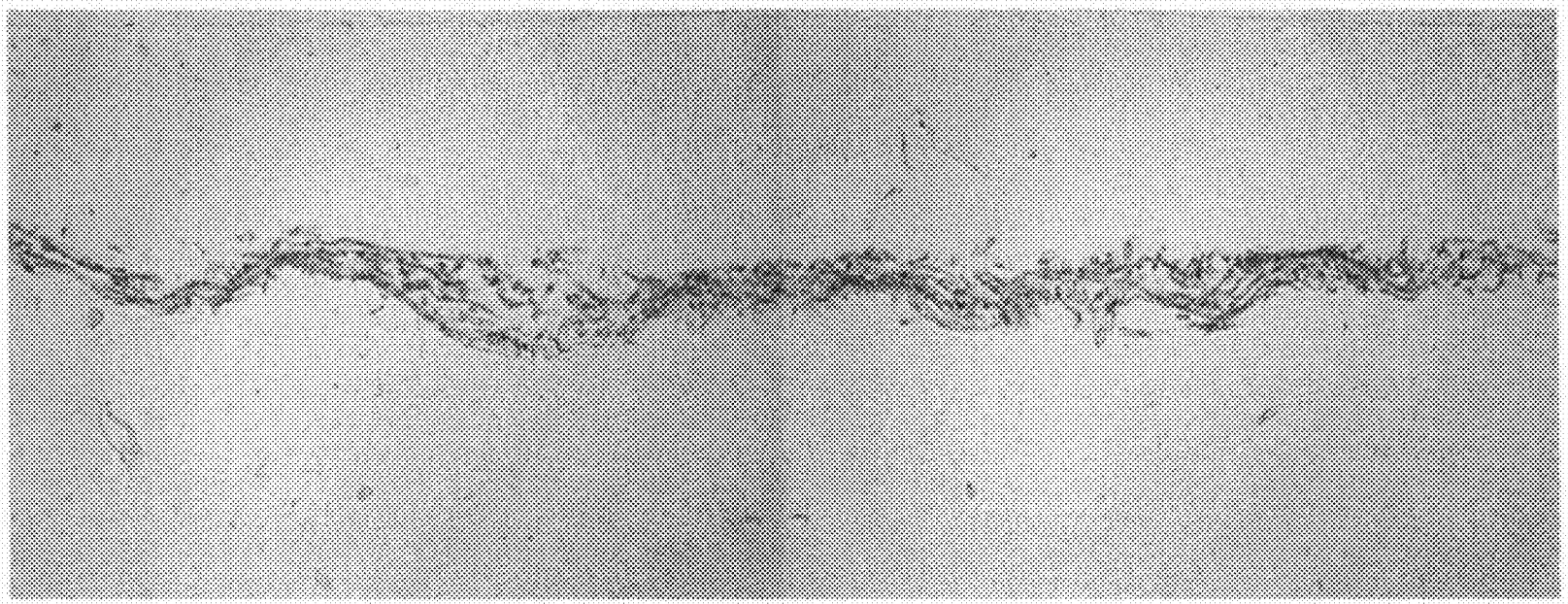

It will be appreciated from FIGS. 1 through 15 that the fabric creped, peeled product of the present invention resembles uncreped throughdried sheet. There is shown in FIGS. 1 through 5 photomicrographs of a through dried product; in this respect FIG. 1 is a photomicrograph (10×) of the top side of the sheet; FIG. 2 is a photomicrograph (10×) of the back side of the sheet; FIG. 3 is a photomicrograph (25×) of the top side of the sheet; and FIG. 4 is a photomicrograph (25×) of the back of the side of the through dried sheet. FIG. 5 is a cross-sectional view (cut along the machine direction, 62.5×) which shows that the sheet is substantially without crepe bars inasmuch as this throughdried sheet has not been dry-creped.

Figure 6:
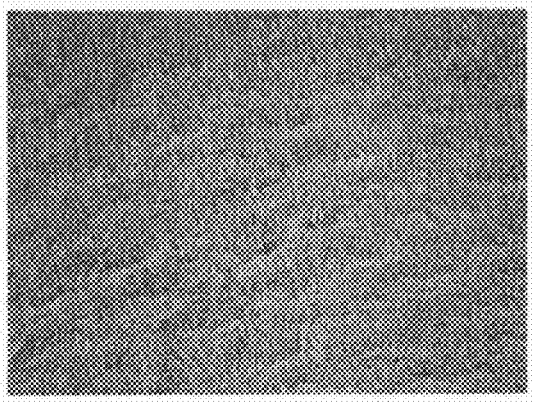
FIGS. 6-15 are photomicrographs of fabric-creped sheet of the invention suitable for automatic towel dispensers.
Figure 7:
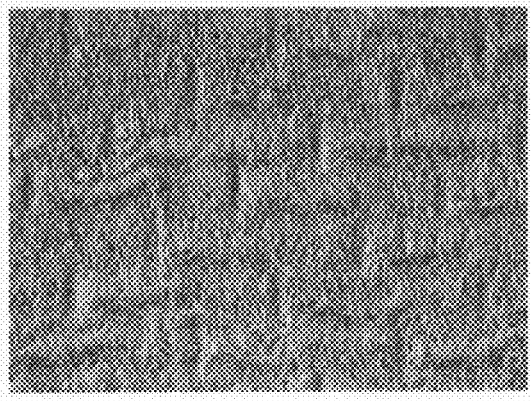
Figure 8:
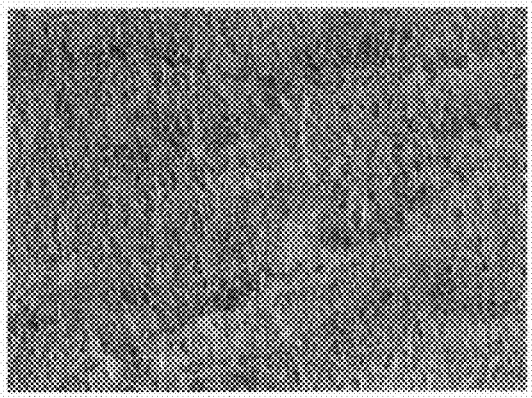
Figure 9:
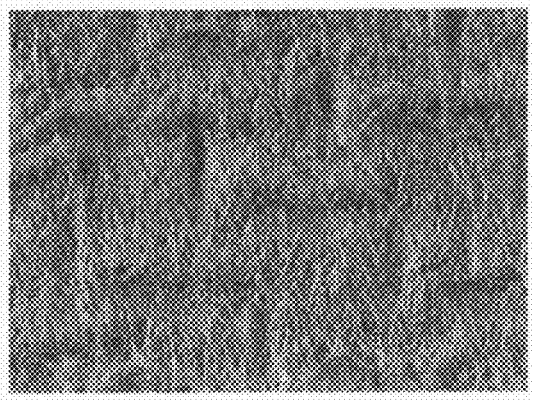
Figure 10:
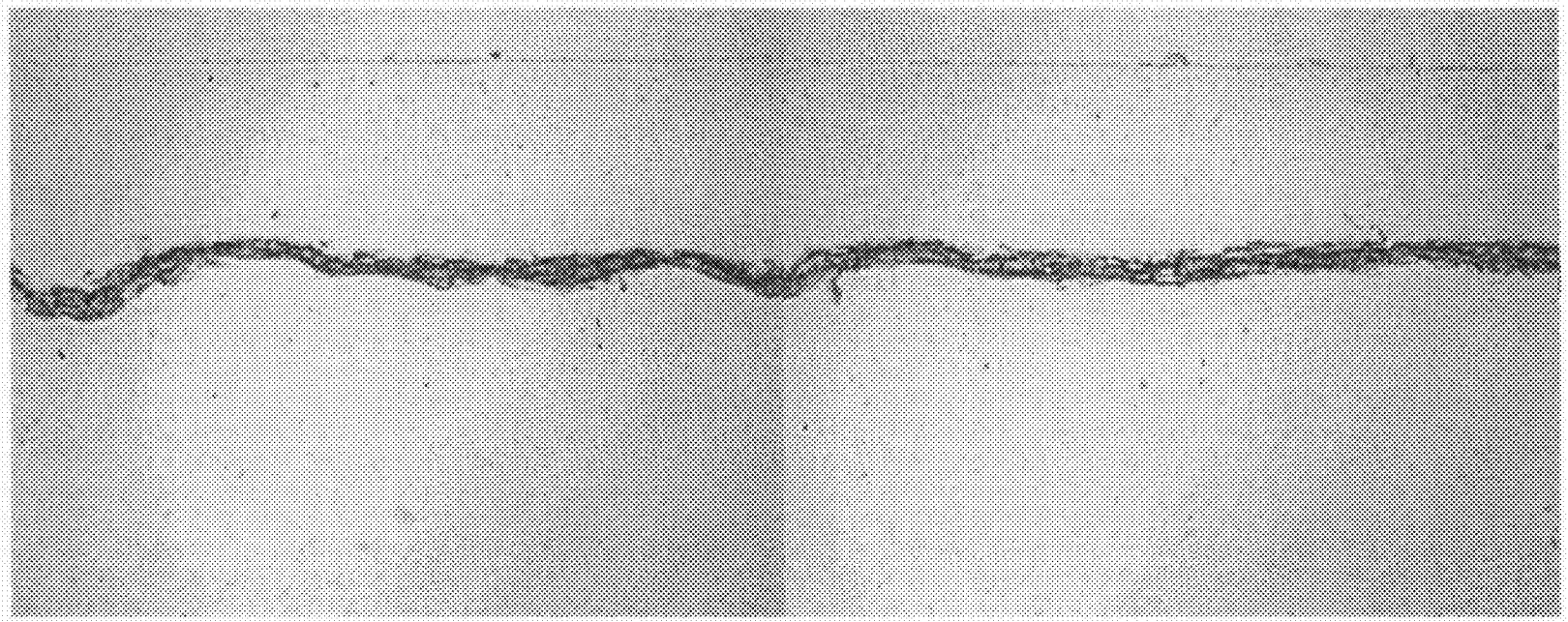

FIGS. 6 through 10 are photomicrographs of a fabric creped sheet which was creped at a 7% fabric crepe and peeled from a Yankee dryer. FIG. 6 is a top side view (10×) of the sheet, while FIG. 7 is a back side view (10×) of the sheet; FIG. 8 is a top side view (25×) of the sheet while FIG. 9 is a back side view (25×) of the sheet; and FIG. 10 is a cross sectional view along the machine direction of the sheet at a magnification of 62.5×.

It can be seen in FIGS. 6 through 10 that the sheet has a good distribution of fiber and that the sheet is substantially without crepe bars of the type which occur when a product is dry-creped from a Yankee cylinder. It is further noted with respect to FIGS. 6 through 10 that the back side of the sheet bears the pattern of the creping fabric used to produce the sheet. Thus, if so desired, the sheet may be made more or less "sided". Alternatively, the sheet may be calendered to reduce sidedness as noted above.

Figure 11:
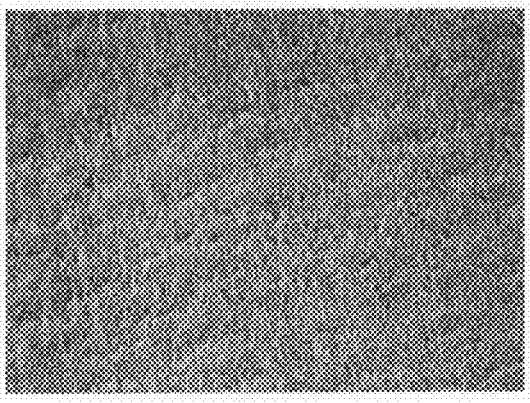
Figure 12:
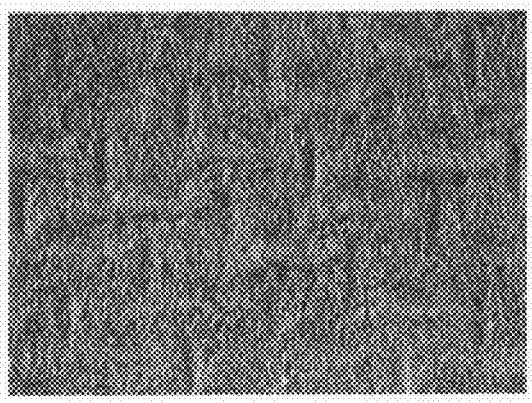
Figure 13:
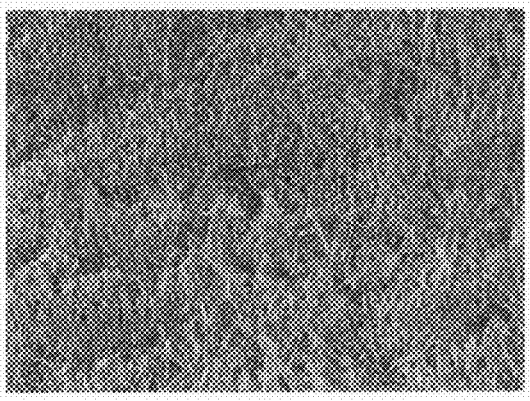
Figure 14:
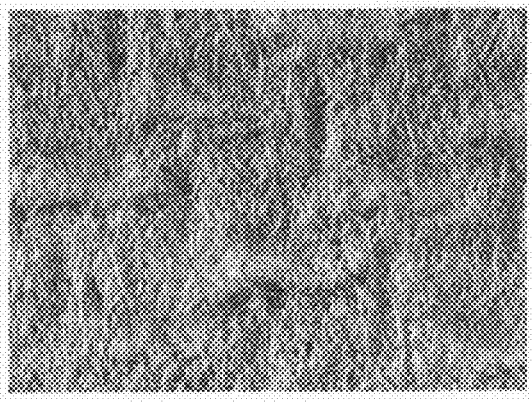
Figure 15:
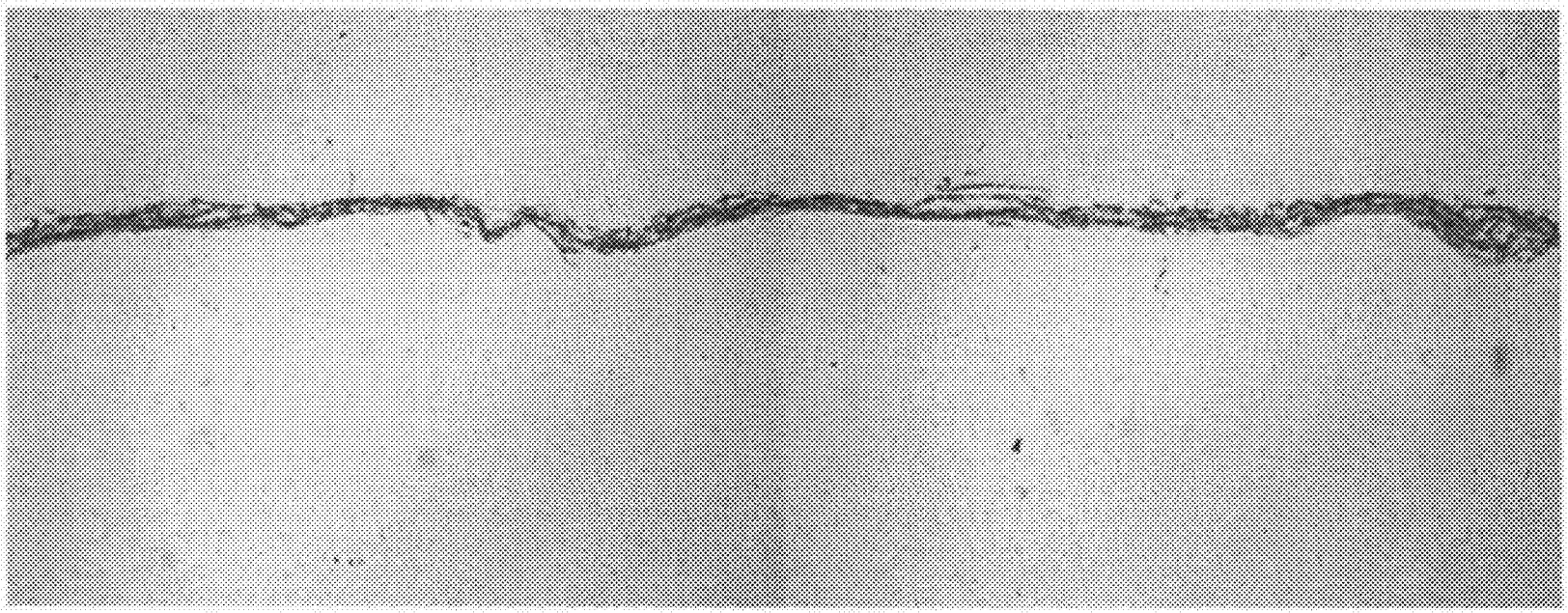

FIGS. 11 through 15 show another fabric creped sheet prepared in accordance with the present invention wherein the sheet was creped with a 5% fabric crepe, thereafter applied to Yankee dryer with a PAE/polyvinyl alcohol adhesive and peeled therefrom. FIG. 11 is a top side view of the sheet at a magnification of 10×; FIG. 12 is a photomicrograph of the back side of the sheet at a magnification of 10×; FIG. 13 is a view of the top side of the sheet at a magnification of 25×; and FIG. 14 is a photomicrograph of the back side of the sheet at a magnification of 25×. FIG. 15 is a cross-sectional view, along the machine direction at a magnification of 62.5×. Here again, it is seen that the fabric creped sheet has a good distribution of fiber and there is a substantial absence of crepe bars.

It is also seen in FIGS. 6 through 15 that the fabric creped sheet has a structure which is somewhat undulatory in the machine direction allowing for stretch as will be appreciated from the examples hereinafter provided.

A preferred method of initiating the inventive process is to start with a furnish that includes a polyacrylamide (i.e., Parez) at 1-11 lbs/ton along with a PAE resin at about 11 lbs/ton and operate the Yankee in a dry, blade-crepe mode with PVOH creping adhesive, creping the web from the cylinder for half an hour to forty-five minutes or so while an adhesive coating builds up on the Yankee. Thereafter, the acrylamide is no longer used in the furnish and carboxymethyl cellulose is used instead at 2-6 lbs/ton of fiber while the web is peeled from the Yankee as described below. Alternatively, if the desired product properties do not require a dry strength agent, start-up may be accomplished without using any dry strength agent.

Figure 16:
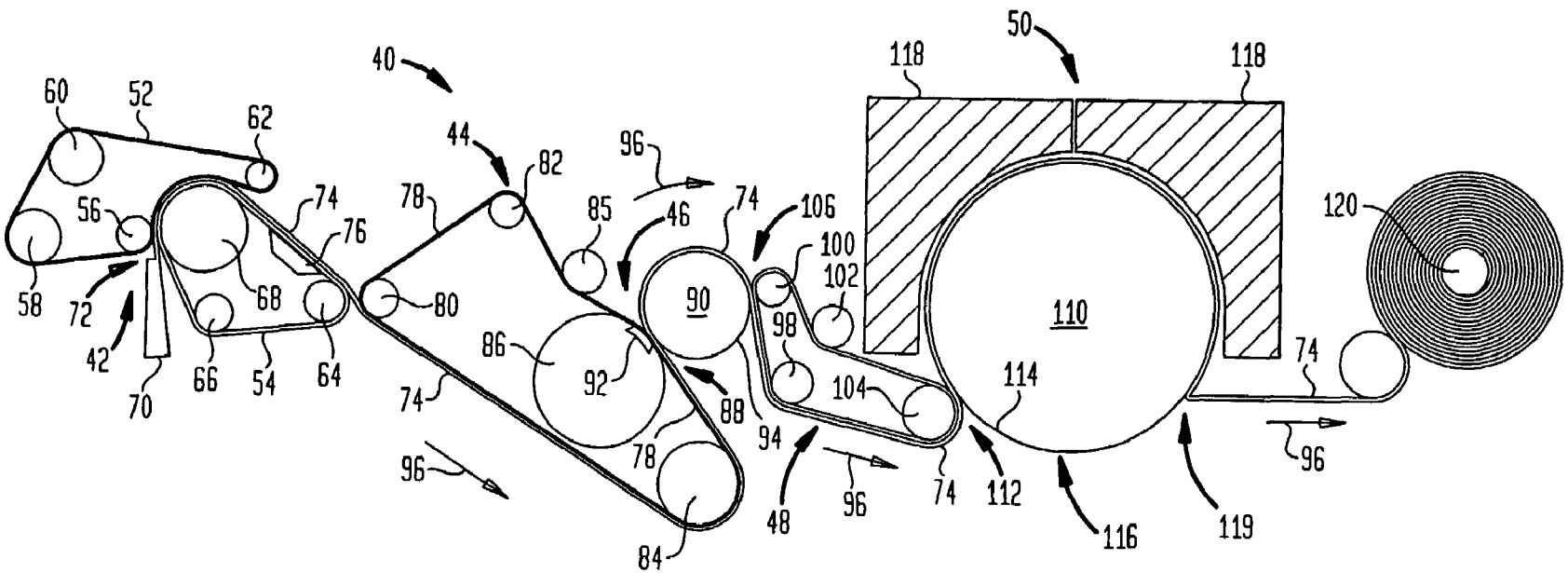
FIG. 16 is a schematic diagram of a first papermachine suitable for practicing the process of the present invention.

FIG. 16 is a schematic diagram of a papermachine 40 having a conventional twin wire forming section 42, a felt run 44, a shoe press section 46 a creping fabric 48 and a Yankee dryer 50 suitable for practicing the present invention. Forming section 42 includes a pair of forming fabrics 52, 54 supported by a plurality of rolls 56, 58, 60, 62, 64, 66 and a forming roll 68. A headbox 70 provides papermaking furnish issuing therefrom as a jet in the machine direction to a nip 72 between forming roll 68 and roll 56 and the fabrics. The furnish forms a nascent web 74 which is dewatered on the fabrics with the assistance of suction, for example, by way of suction box 76.

The nascent web is advanced to a papermaking felt 78 which is supported by a plurality of rolls 80, 82, 84, 85 and the felt is in contact with a shoe press roll 86. The web is of low consistency as it is transferred to the felt. Transfer may be assisted by suction; for example roll 80 may be a suction roll if so desired or a pickup or suction shoe as is known in the art. As the web reaches the shoe press roll it may have a consistency of 10-25 percent, preferably 20 to 25 percent or so as it enters nip 88 between shoe press roll 86 and transfer roll 90. Transfer roll 90 may be a heated roll if so desired. Instead of a shoe press roll, roll 86 could be a conventional suction pressure roll. If a shoe press is employed, it is desirable and preferred that roll 84 is a suction roll effective to remove water from the felt prior to the felt entering the shoe press nip since water from the furnish will be pressed into the felt in the shoe press nip. In any case, using a suction roll at 84 is typically desirable to ensure the web remains in contact with the felt during the direction change as one of skill in the art will appreciate from the diagram.

Web 74 is wet-pressed on the felt in nip 88 with the assistance of pressure shoe 92. The web is thus compactively dewatered at 88, typically by increasing the consistency by 15 or more points at this stage of the process. The configuration shown at 88 is generally termed a shoe press; in connection with the present invention, cylinder 90 is operative as a transfer cylinder which operates to convey web 74 at high speed, typically 1000 fpm-6000 fpm, to the creping fabric.

Cylinder 90 has a smooth surface 94 which may be provided with adhesive and/or release agents if needed. Web 74 is adhered to transfer surface 94 of cylinder 90 which is rotating at a high angular velocity as the web continues to advance in the machine-direction indicated by arrows 96. On the cylinder, web 74 has a generally random apparent distribution of fiber.

Direction 96 is referred to as the machine-direction (MD) of the web as well as that of papermachine 40; whereas the cross-machine-direction (CD) is the direction in the plane of the web perpendicular to the MD.

Web 74 enters nip 88 typically at consistencies of 10-25 percent or so and is dewatered and dried to consistencies of from about 35 to about 70 by the time it is transferred to creping fabric 48 as shown in the diagram.

Fabric 48 is supported on a plurality of rolls 98, 100, 102 and a press nip roll 104 and forms a fabric crepe nip 106 with transfer cylinder 90 as shown.

The creping fabric defines a creping nip over the distance (nip width) in which creping fabric 48 is adapted to contact roll 90; that is, applies significant pressure to the web against the transfer cylinder. To this end, backing (or creping) roll 100 may be provided with a soft deformable surface which will increase the width of the creping nip and increase the fabric creping angle between the fabric and the sheet and the point of contact or a shoe press roll could be used as roll 100 to increase effective contact with the web in high impact fabric creping nip 106 where web 74 is transferred to fabric 48 and advanced in the machine-direction.

Creping nip 106 generally extends over a fabric creping nip width or distance of anywhere from about ⅛" to about 2", typically ½" to 2". For a creping fabric with 32 CD strands per inch, web 74 thus will encounter anywhere from about 4 to 64 weft filaments in the nip.

The nip pressure in nip 106, that is, the loading between backing roll 100 and transfer roll 90 is suitably 20-200, preferably 40-70 pounds per linear inch (PLI).

After fabric creping, the web continues to advance along MD 96 where it is wet-pressed onto Yankee cylinder 110 in transfer nip 112. Transfer at nip 112 occurs at a web consistency of generally from about 25 or 30 to about 70 percent. At these consistencies, it is difficult to adhere the web to surface 114 of cylinder 110 firmly enough to remove the web from the fabric thoroughly. This aspect of the process is important, particularly when it is desired to use a high velocity drying hood.

It has been found in accordance with the present invention that the use of particular adhesives cooperate with a moderately moist web (30-70 percent consistency) to adhere it to the Yankee sufficiently to allow for high velocity operation of the system and high jet velocity impingement air drying and subsequent peeling of the web from the Yankee. In this connection, a poly(vinyl alcohol)/polyamide adhesive composition as noted above is applied at 116 as needed, preferably at a rate of less than about 40 mg/m$^2$ of sheet.

The web is dried on Yankee cylinder 110 which is a heated cylinder and by high jet velocity impingement air in Yankee hood 118. As the cylinder rotates, web 74 is peeled from the cylinder at 119 and wound on a take-up reel 120.

Figure 17:
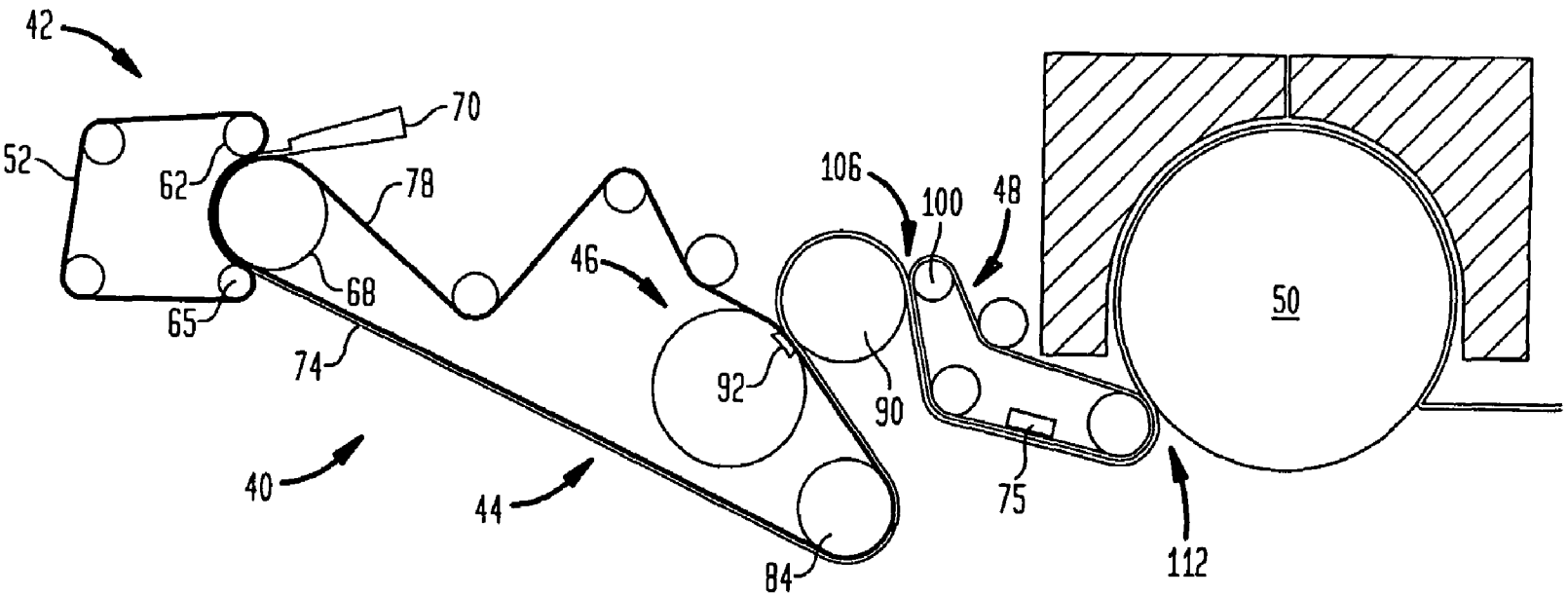
FIG. 17 is a schematic diagram of a second papermachine suitable for producing the present invention.

There is shown in FIG. 17 a preferred papermachine 40 for use in connection with the present invention. Papermachine 40 is a three fabric loop machine having a forming section 42 generally referred to in the art as a crescent former. Forming section 42 includes a forming wire 52 supported by a plurality of rolls such as rolls 62, 65. The forming section also includes a forming roll 68 which supports paper making felt 78 such that web 74 is formed directly on felt 78. Felt run 44 extends to a shoe press section 46 wherein the moist web is deposited on a transfer roll 90 as described above. Thereafter web 74 is creped onto fabric 48 in fabric crepe nip 106 between rolls 90, 100 before being deposited on Yankee dryer in another press nip 112. Suction is optionally applied by suction box 75 as the web is held in fabric. Headbox 70 and press shoe 92 operate as noted above in connection with FIG. 16. The system includes a suction turning roll 84, in some embodiments; however, the three loop system may be configured in a variety of ways wherein a turning roll is not necessary.

Figure 18:
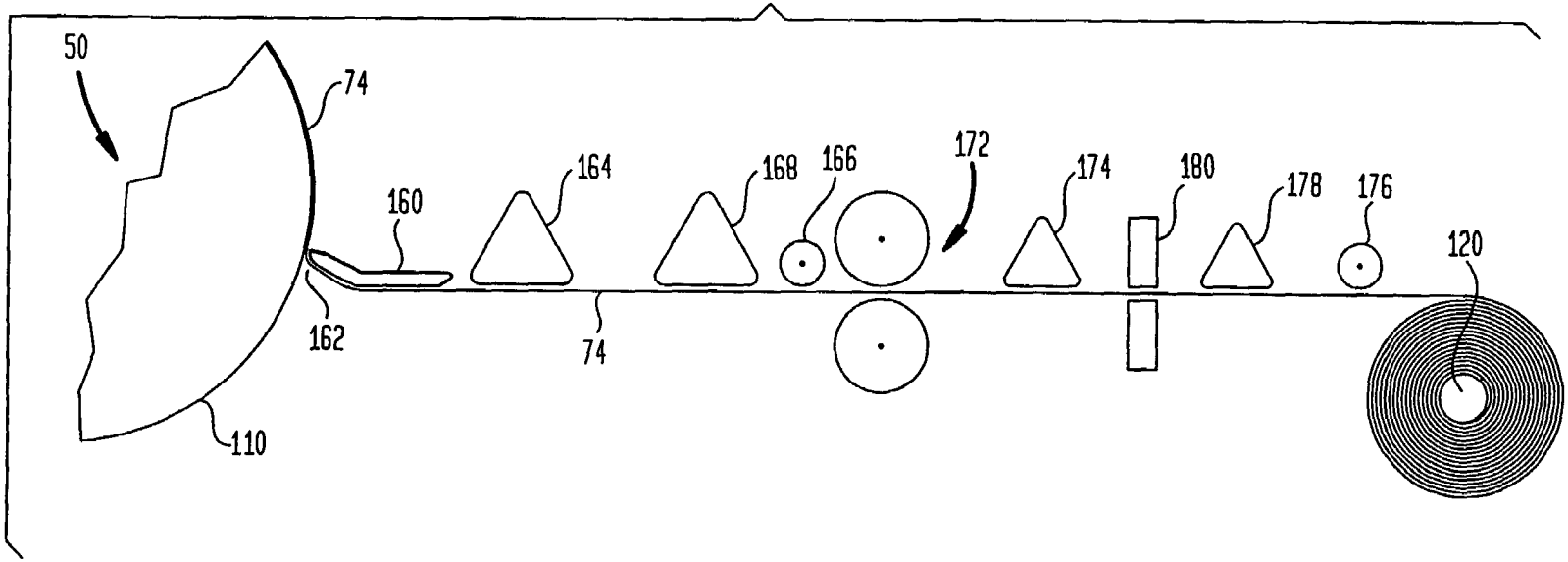
FIGS. 18 and 19 are schematic diagrams illustrating the use of air foils in connection with the present invention.
Figure 19:
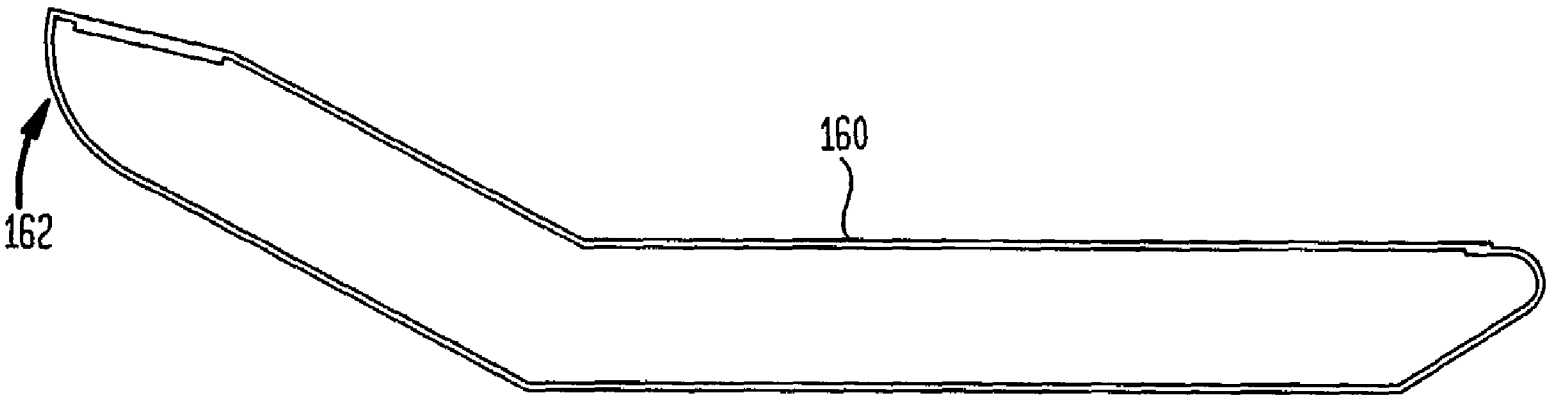

Any suitable line arrangement may be used downstream of Yankee dryer 50 between the Yankee dryer and take up reel 120. One preferred layout is shown schematically in FIGS. 18 and 19. There is shown a Yankee cylinder 110 upon which the sheet is dried and in proximity therewith a first foil 160 which has a rounded edge 162 adjacent the Yankee dryer. The rounded edge of the foil is in close proximity with the surface of cylinder 110. Preferably any open draw is provided with some form of stabilizing airfoil and there are provided tensioners so as to prevent wrinkling of the sheet.

As the sheet is peeled from cylinder 110 the sheet may contact rounded surface 162 of foil 160 inasmuch as the sheet is typically separated from the Yankee above the foil. Second and third airfoils 164, 168 stabilize the web over open draw along the production line. Thereafter a spreader bar or bow roll 166 may be used to apply tension to the web in order to prevent wrinkling as the web progresses to an optional calender stack 172. Stack 172 may be used to calender the web especially if it is desired to reduce sidedness. While any suitable calender load may be employed, it is preferred that the calender load be between about 15 and about 25 pli.

Between calender stack 172 and reel 120 there is provided a Measurex® control instrument 180 to measure consistency and basis weight in order to provide data for feedback control of the papermachine. Fourth and fifth airfoils 174, 178 stabilize the web on either side of the Measurex® instrument. Another spreader bar or bow roll 176 is provided in front of reel 120 in order to tension the web. In utilizing the arrangement illustrated in FIGS. 18 and 19, it is preferred that calender stack 172 be synchronized with reel 120 prior to loading the calender stack. After loading, reel 120 can be speeded up to be slightly faster than calendar stack 172 (3-10 fpm faster) to promote good winding.

EXAMPLES

Following the procedures and using the materials noted above, a series of absorbent base sheets were prepared and tested for dispensing performance in automatic dispensers. Details and results appear in Tables 3-6 below.

TABLE 3

Towel Composition and Properties

| Roll ID | HS-FCT | E0222133 | E0220133 | E0219133 | E1228100 | E1227100 | E1834133 |
|---|---|---|---|---|---|---|---|
| MODE | Creped | Peeled | Peeled | Peeled | Peeled | Peeled | Peeled |
| Fabric Crepe % | 12% | 7% | 10% | 15% | 7% | 10% | 7% |
| PVOH/PAE (mg/m^2) | 54 | 25 | 25 | 25 | 21 | 21 | 18 |
| Modifier (ml/min) | 500 | 20 | 20 | 20 | 75 | 75 | 22 |
| Leaf River SWK % | | | | | | | |
| Camas B16 SWK % | | | | | 100% | 100% | |
| Peace River SWK % | 60% | 80% | 80% | 80% | | | 100% |
| Fox River 2nd Fiber % | 40% | 20% | 20% | 20% | | | |
| WSR (#/T) | 11 | 11 | 11 | 11 | 12 | 12 | 10 |
| Parez 631 (#/T) | 11 | 14 | 14 | 14 | 13 | 13 | 11 |
| CMC (#/T) | | | | | | | |
| Refining (hp) | 80% | 80% | 80% | 80% | 80% | 80% | 80% |

TABLE 3-continued

| Towel Composition and Properties | | | | | | | |
|---|---|---|---|---|---|---|---|
| Yankee Steam (psi) | 110 | 80 | 80 | 80 | 80 | 80 | 80 |
| Basis Weight (lbs/rm) | 23.4 | 23.6 | 23.5 | 22.6 | 22.9 | 22.6 | 23.1 |
| Caliper (mils/8 sheets) | 55.0 | 50.2 | 51.9 | 53.6 | 57.0 | 61.0 | 58.0 |
| Dry MD Tensile (g/3") | 5258 | 8177 | 6350 | 5331 | 6821 | 5831 | 6454 |
| Dry CD Tensile (g/3") | 3594 | 4282 | 4739 | 3558 | 4044 | 4294 | 3939 |
| MD Stretch (%) | 12 | 9 | 10 | 14 | 10 | 12 | 9 |
| CD Stretch (%) | 3 | 2 | 3 | 3 | 3 | 3 | 3 |
| Wet MD Cured Tensile (g/3") (Finch) | | 2125 | 1329 | 1570 | 1634 | 1484 | 1584 |
| Wet CD Cured Tensile (g/3") (Finch) | 861 | 1061 | 835 | 881 | 889 | 1040 | 917 |
| WAR (seconds) (TAPPI) | 15 | 35 | 39 | 25 | 30 | 31 | 24 |
| Slow SAT (g/g) | 3.23 | 3.24 | 4.18 | 5.35 | 3.09 | 3.04 | 3.95 |
| GM Break Modulus | 712 | 1265 | 1048 | 700 | 934 | 798 | 934 |
| Dry Tensile Ratio | 1.46 | 1.91 | 1.34 | 1.50 | 1.69 | 1.36 | 1.64 |
| CD Wet/Dry | 24% | 25% | 18% | 25% | 22% | 24% | 23% |
| Total Dust (mg/ft^2) | 3.62 | 1.85 | 0.72 | 0.83 | 0.34 | 0.18 | 1.03 |
| MD Bending Length (cm) | 2.63 | 4.16 | 4.00 | 3.43 | 4.12 | 4.00 | 3.71 |

| Roll ID | 5E1832133 | E2635100 | E2639100 (CAL) | F0230133 (CAL) | F0236133 (CAL) | 0243133/100 (CAL) |
|---|---|---|---|---|---|---|
| MODE | Peeled | Peeled | Peeled | Peeled | Peeled | Peeled |
| Fabric Crepe % | 10% | 7% | 7% | 7% | 5% | 5% |
| PVOH/PAE (mg/m^2) | 18 | 20 | 20 | 20 | 20 | 20 |
| Modifier (ml/min) | 22 | 50 | 50 | 20 | 20 | 20 |
| Leaf River SWK % | | | | | | |
| Camas B16 SWK % | | 100% | 100% | 100% | 100% | 100% |
| Peace River SWK % | 100% | | | | | |
| Fox River 2nd Fiber % | | | | | | |
| WSR (#/T) | 10 | 11 | 14 | 14 | 14 | 15 |
| Parez 631 (#/T) | 11 | 12 | 12 | 11 | 11 | 0 |
| CMC (#/T) | | | | | | 5 |
| Refining (hp) | 80% | By Pass | By Pass | By Pass | By Pass | By Pass |
| Yankee Steam (psi) | 80 | 80 | 80 | 80 | 80 | 80 |
| Basis Weight (lbs/rm) | 22.6 | 23.3 | 23.0 | 22.9 | 22.9 | 23.2 |
| Caliper (mils/8 sheets) | 64.6 | 55.1 | 53.3 | 53.3 | 50.6 | 52.8 |
| Dry MD Tensile (g/3") | 5382 | 5761 | 5482 | 5504 | 5205 | 6169 |
| Dry CD Tensile (g/3") | 3235 | 3910 | 3758 | 3422 | 3134 | 3388 |
| MD Stretch (%) | 12 | 8 | 8 | 8 | 7 | 7 |
| CD Stretch (%) | 3 | 3 | 3 | 3 | 3 | 3 |
| Wet MD Cured Tensile (g/3") (Finch) | 1506 | 1426 | 1255 | 1500 | 996 | 1691 |
| Wet CD Cured Tensile (g/3") (Finch) | 772 | 932 | 775 | 998 | 688 | 970 |
| WAR (seconds) (TAPPI) | 21 | 33 | 23 | 27 | 22 | 13 |
| Slow SAT (g/g) | 4.28 | 3.57 | 4.88 | 4.59 | 3.79 | 5.36 |
| GM Break Modulus | 697 | 1002 | 956 | 881 | 922 | 971 |
| Dry Tensile Ratio | 1.66 | 1.47 | 1.46 | 1.61 | 1.66 | 1.82 |
| CD Wet/Dry | 24% | 24% | 21% | 29% | 22% | 29% |
| Total Dust (mg/ft^2) | 1.26 | 0.38 | 0.30 | 0.80 | 1.02 | 0.75 |
| MD Bending Length (cm) | 3.44 | 3.93 | 3.86 | 3.74 | 3.80 | 4.09 |

TABLE 4

| Dispensing Test for Towel | | | | | | | |
|---|---|---|---|---|---|---|---|
| Roll ID | HS-FCT | E0222133 | E0220133 | E0219133 | E1228100 | E1227100 | E1834133 |
| MODE | Creped | Peeled | Peeled | Peeled | Peeled | Peeled | Peeled |
| #Rolls Dispensed | 55 | 10 | 10 | 10 | 10 | 10 | 10 |
| Estimate #Pulls | 44000 | 8000 | 8000 | 8000 | 8000 | 8000 | 8000 |
| Dispensing Defect—Partial Bunch | 98 | 4 | 1 | 4 | 0 | 1 | 2 |
| Dispensing Defect—Whole Bunch | 10 | 0 | 0 | 0 | 0 | 0 | 0 |
| Dispensing Defect—Hanging Loop | 1 | 0 | 0 | 0 | 0 | 0 | 0 |
| # Dispensing Defects per Roll | 1.98 | 0.40 | 0.10 | 0.40 | 0.00 | 0.10 | 0.20 |
| #rolls Have Dispensing Defects | 32 | 1 | 1 | 3 | 0 | 1 | 2 |
| % Roll Having Dispensing Defects | 58% | 10% | 10% | 30% | 0% | 10% | 20% |

TABLE 4-continued

| Dispensing Test for Towel | | | | | | |
|---|---|---|---|---|---|---|
| Roll ID | E1832133 | E2635100 | E2639100 (CAL) | F0230133 (CAL) | F0236133 (CAL) | F0243133/100 (CAL) |
| MODE | Peeled | Peeled | Peeled | Peeled | Peeled | Peeled |
| #Rolls Dispensed | 10 | 10 | 10 | 10 | 10 | 20 |
| Estimate #Pulls | 8000 | 8000 | 8000 | 8000 | 8000 | 16000 |
| Dispensing Defect—Partial Bunch | 0 | 2 | 0 | 1 | 1 | 2 |
| Dispensing Defect—Whole Bunch | 1 | 1 | 0 | 0 | 0 | 0 |
| Dispensing Defect—Hanging Loop | 0 | 0 | 0 | 0 | 0 | 0 |
| # Dispensing Defects per Roll | 0.10 | 0.30 | 0.00 | 0.10 | 0.10 | 0.10 |
| #rolls Have Dispensing Defects | 1 | 1 | 0 | 1 | 1 | 2 |
| % Roll Having Dispensing Defects | 10% | 10% | 0% | 10% | 10% | 10% |

TABLE 5

| Towel Composition and Properties | | | | | | | | |
|---|---|---|---|---|---|---|---|---|
| | 100% Marathon (NSW) | | | | 100% Leaf River (SSW) | | 100% Douglas fir | |
| Roll ID | 7784 | 8226 | 7761 | 8229 | 7752 | 8197 | 8212 | 8214 |
| MODE | Creped | Peeled | Creped | Peeled | Creped | Peeled | Peeled | Peeled |
| Fabric Crepe % | 7% | 7% | 10% | 10% | 3% | 7% | 7% | 10% |
| PVOH (#/T) | 3.50 | 1.10 | 3.50 | 1.10 | 3.50 | 0.37 | 1.10 | 1.10 |
| PAE (#/T) | 1 | 0.37 | 1 | 0.37 | 1 | 0.13 | 0.37 | 0.37 |
| Modifier (#/T) | 2 | 0.00 | 2 | 0.00 | 2 | 0.00 | 0.00 | 0.00 |
| SWK % | 100 | 100 | 100 | 100 | 100 | 100 | 100 | 100 |
| WSR (#/T) | 22 | 7 | 22 | 7 | 20 | 20 | 15 | 12 |
| Parez 631 (#/T) | 3 | | 3 | | 6 | | | |
| CMC (#/T) | 0 | 0 | 0 | 0 | | 6 | 6 | 5 |
| Basis Weight (lbs/rm) | 24.3 | 22.4 | 23.7 | 22.5 | 23.9 | 22.4 | 22.9 | 22.9 |
| Caliper (mils/8 sheets) | 50.7 | 51.2 | 56.3 | 54.5 | 49.8 | 47.1 | 52.3 | 58.1 |
| Dry MD Tensile (g/3") | 7854 | 7330 | 9758 | 6886 | 8093 | 6439 | 6562 | 5809 |
| Dry CD Tensile (g/3") | 5481 | 4820 | 5376 | 4788 | 5565 | 4483 | 4825 | 4455 |
| MD Stretch (%) | 13 | 9 | 18 | 11 | 10 | 9 | 9 | 11 |
| CD Stretch (%) | 5 | 4 | 5 | 4 | 4 | 5 | 4 | 4 |
| Wet MD Cured Tensile (g/3") (Finch) | 2371 | 2220 | 2645 | 2018 | 2198 | 2138 | 1964 | 1682 |
| Wet CD Cured Tensile (g/3") (Finch) | 1416 | 1186 | 1229 | 1226 | 1338 | 1306 | 1191 | 1091 |
| WAR (seconds) (TAPPI) | 6 | 16 | 13 | 13 | 45 | 14 | 21 | 15 |
| Slow SAT Capacity (g/m^2) | 140 | 136 | 132 | 184 | 104 | 178 | 165 | 132 |
| GM Break Modulus | 802 | 1046 | 748 | 919 | 1011 | 810 | 1008 | 773 |
| ASTM MD Bending Length (cm) | 2.7 | 3.5 | 2.5 | 3.3 | 2.7 | 3.5 | 3.9 | 3.2 |

TABLE 6

| | Dispensing Test for Towel | | | | | | | |
|---|---|---|---|---|---|---|---|---|
| | 100% Marathon (NSW) | | | | 100% Leaf River (SSW) | | 100% Douglas fir | |
| Roll ID | 7784 | 8226 | 7761 | 8229 | 7752 | 8197 | 8212 | 8214 |
| MODE | Creped | Peeled | Creped | Peeled | Creped | Peeled | Peeled | Peeled |
| #Rolls Dispensed | 6 | 6 | 6 | 6 | 6 | 6 | 6 | 6 |
| Partial Bunch | 15 | 0 | 11 | 3 | 1 | 1 | 1 | 1 |
| Whole Bunch | 0 | 1 | 0 | 1 | 0 | 0 | 0 | 0 |
| Hanging Loop | 0 | 1 | 0 | 0 | 0 | 0 | 0 | 0 |
| Wrapped around pinch roller | 0 | 0 | 1 | 0 | 0 | 0 | 0 | 0 |
| % Dispensing Defect per roll | 2.5% | 0.33% | 2.0% | 0.67% | 0.17% | 0.17% | 0.17% | 0.17% |
| # Rolls Have Defects | 5 | 2 | 3 | 3 | 1 | 1 | 1 | 1 |
| % Roll Having Dispensing Defects | 83% | 33% | 50% | 50% | 17% | 17% | 17% | 17% |

Figure 20:
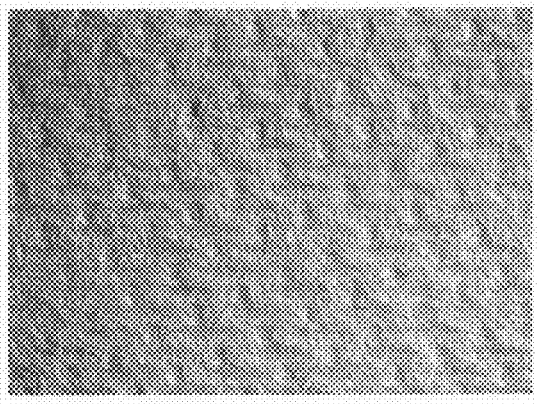
FIGS. 20 and 21 are photomicrographs of uncreped TAD sheet.
Figure 21:
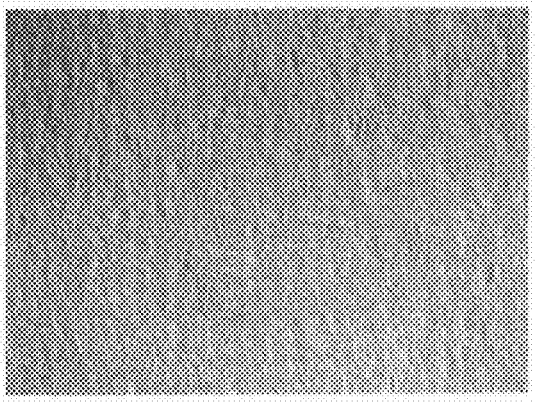
Figure 22:
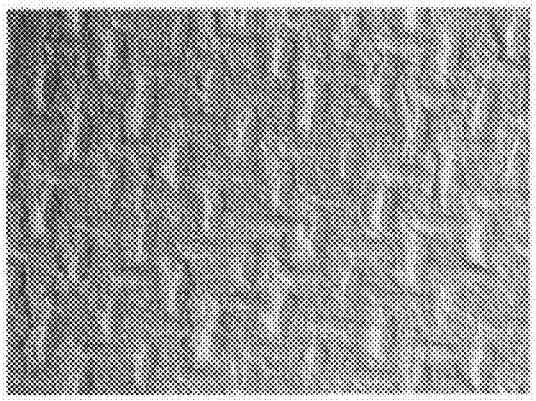
FIGS. 22 and 23 are photomicrographs of fabric-creped, peeled sheet of the invention.
Figure 23:
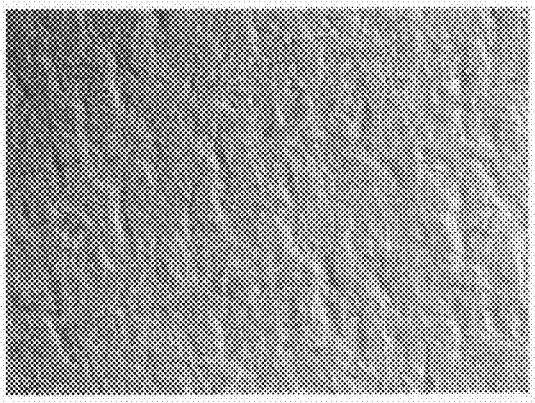
Figure 24:
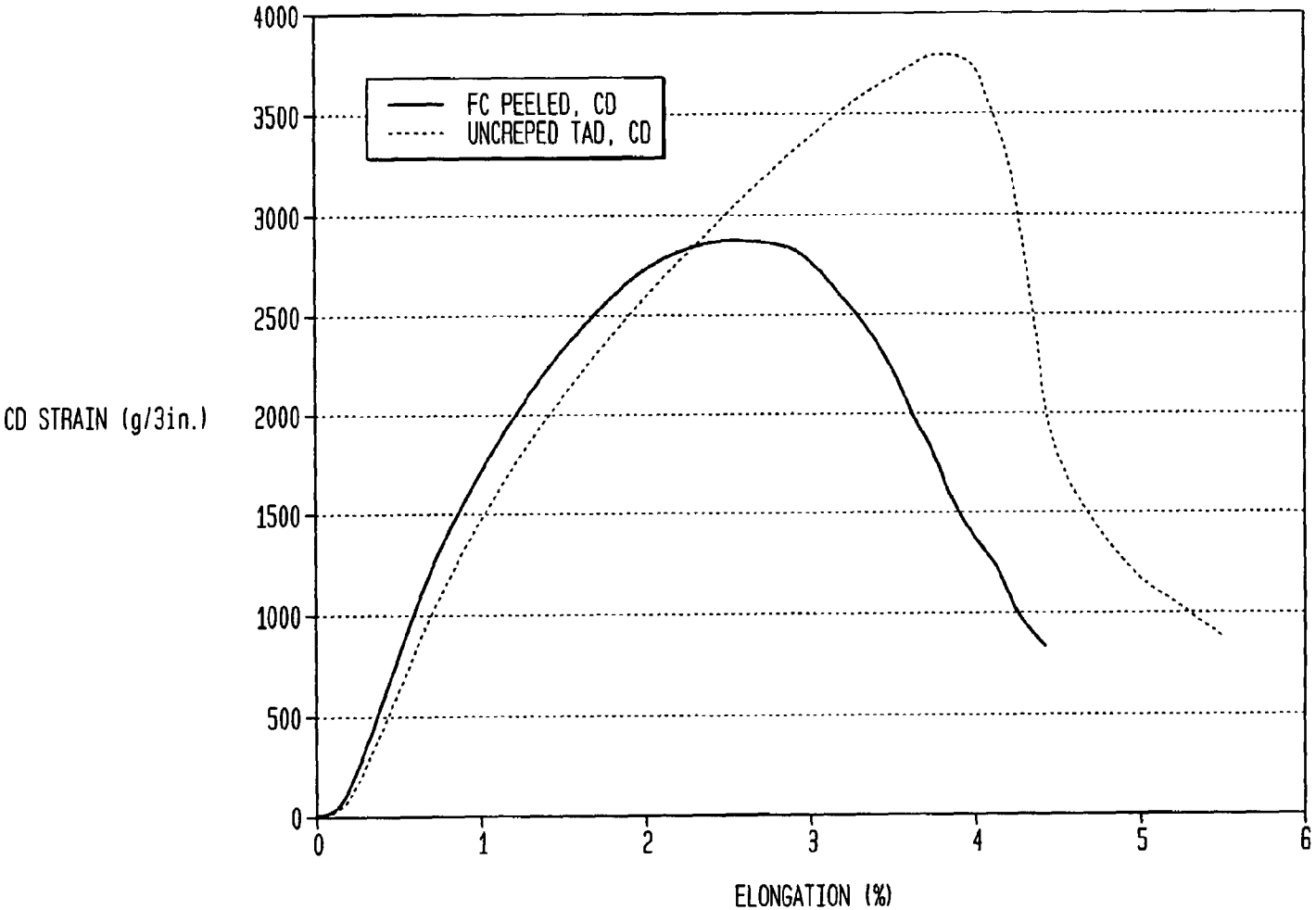
FIGS. 24 and 25 are graphs comparing tensile properties of uncreped TAD sheet and the fabric creped, peeled sheet of the invention.

It will be appreciated from Tables 3 to 6 that the fabric creped, peeled product of the invention exhibited a large increase in MD bending length with respect to the fabric creped, dry creped product. Moreover, the dispensing testing shows that the product was dramatically superior for dispensing in automatic towel dispensers. The present invention is further appreciated by reference to FIGS. 20-23. In FIGS. 20, 21, there is shown uncreped throughdried sheet, whereas in FIGS. 22, 23 there is shown the absorbent sheet of the invention. Tensile characteristics are compared in FIGS. 24, 25. It is seen from FIG. 25 that the fabric creped sheet has considerably more MD elongation or stretch prior to yield.

Utilizing the above procedures, additional "peeled" towel products were prepared utilizing the W013 fabric referred to above and compared with other products. Process parameters and product attributes are in Tables 7, 8 and 9, below.

TABLE 7

| | Single-Ply Towel Sheet | | | | |
|---|---|---|---|---|---|
| Roll ID | 11429 | 11418 | 11441 | 11405 | 11137 |
| NSWK | 100% | 50% | 100% | 50% | |
| Recycled Fiber | | 50% | | 50% | 100% |
| % Fabric Crepe | 5% | 5% | 5% | 5% | 5% |
| Suction (Hg) | 23 | 23 | 23 | 23 | 23 |
| WSR (#/T) | 12 | 12 | 12 | 12 | 12 |
| CMC (#/T) | 3 | 1 | 2 | 1 | 1 |
| Parez 631 (#/T) | 9 | 6 | 9 | 3 | 0 |
| PVOH (#/T) | 0.75 | 0.75 | 0.75 | 0.75 | 0.45 |
| PAE (#/T) | 0.25 | 0.25 | 0.25 | 0.25 | 0.15 |
| Modifier (#/T) | 0.25 | 0.25 | 0.25 | 0.25 | 0.15 |
| Yankee Speed (fpm) | 1599 | 1768 | 1599 | 1598 | 1598 |
| Reel Speed (fpm) | 1609 | 1781 | 1609 | 1612 | 1605 |
| Basis Weight (lbs/rm) | 18.4 | 18.8 | 21.1 | 21.0 | 20.3 |
| Caliper (mils/8 sheets) | 41 | 44 | 44 | 45 | 44 |
| Dry MD Tensile (g/3") | 4861 | 5517 | 6392 | 6147 | 7792 |
| Dry CD Tensile (g/3") | 3333 | 3983 | 3743 | 3707 | 4359 |
| GMT (g/3") | 4025 | 4688 | 4891 | 4773 | 5828 |
| MD Stretch (%) | 6.9 | 6.6 | 7.2 | 6.2 | 6.4 |
| CD Stretch (%) | 5.0 | 5.0 | 4.8 | 5.0 | 4.9 |
| Wet MD Cured Tensile (g/3") (Finch) | 1441 | 1447 | 1644 | 1571 | 2791 |
| Wet CD Cured Tensile (g/3") (Finch) | 1074 | 1073 | 1029 | 1064 | 1257 |
| WAR (seconds) (TAPPI) | 33 | 32 | 20 | 20 | 39 |
| MacBeth 3100 L* UV Included | 95.3 | 95.2 | 95.2 | 95.4 | 95.4 |
| MacBeth 3100 A* UV Included | −0.8 | −0.4 | −0.8 | −0.3 | 0.0 |
| MacBeth 3100 B* UV Included | 6.2 | 3.5 | 6.2 | 3.3 | 1.1 |
| MacBeth 3100 Brightness (%) UV Included | 80.6 | 83.5 | 80.3 | 84.3 | 87.1 |
| GM Break Modulus | 691 | 817 | 831 | 858 | 1033 |
| Sheet Width (inches) | 7.9 | 7.9 | 7.9 | 7.9 | 7.9 |
| Roll Diameter (inches) | 7.8 | 7.9 | 8.0 | 7.9 | 8.1 |
| Roll Compression (%) | 1.3 | 1.3 | 1.2 | 1.1 | 1.1 |
| AVE Bending Length (cm) | 3.7 | 3.9 | 4.0 | 4.1 | 4.7 |

TABLE 8

| | Single-Ply Towel | | | | | | | |
|---|---|---|---|---|---|---|---|---|
| Roll ID | 89460 11443 | 89460 11414 | 89460 11437 | 89460 11396 | 89460 11137 | Target | Max | Min |
| NSWK | 100% | 50% | 100% | 50% | | | | |
| Recycled Fiber | | 50% | | 50% | 100% | | | |
| Parez 631 (#/T) | 9 | 6 | 9 | 3 | 0 | | | |
| PVOH (#/T) | 0.75 | 0.75 | 0.75 | 0.75 | 0.45 | | | |
| PAE (#/T) | 0.25 | 0.25 | 0.25 | 0.25 | 0.15 | | | |
| Modifier (#/T) | 0.25 | 0.25 | 0.25 | 0.25 | 0.15 | | | |
| Basis Weight (lbs/rm) | 18.4 | 18.4 | 21.1 | 20.9 | 20.0 | 20.8 | 22.0 | 19.6 |
| Caliper (mils/8 sheets) | 48 | 52 | 49 | 53 | 47 | 50 | 55 | 45 |
| Dry MD Tensile (g/3") | 5050 | 5374 | 6470 | 6345 | 7814 | 6500 | 8000 | 5000 |
| Dry CD Tensile (g/3") | 3678 | 3928 | 3869 | 3817 | 4314 | 4000 | 5000 | 3000 |
| MD Stretch (%) | 7.0 | 7.5 | 7.2 | 7.4 | 7.0 | 6 | 8 | 4 |
| CD Stretch (%) | 4.9 | 5.2 | 4.8 | 5.2 | 4.9 | | | |
| Wet MD Cured Tensile (g/3") (Finch) | 1711 | 1557 | 1888 | 1851 | 2258 | | | |
| Wet CD Cured Tensile (g/3") (Finch) | 1105 | 1086 | 1005 | 1163 | 1115 | 900 | 1250 | 625 |
| WAR (seconds) (TAPPI) | 43 | 29 | 26 | 23 | 34 | 18 | 35 | 1 |
| MacBeth 3100 L* UV Included | 95.1 | 95.1 | 95.0 | 95.2 | 95.5 | | | |
| MacBeth 3100 A* UV Included | −0.9 | −0.4 | −0.8 | −0.4 | −0.3 | | | |
| MacBeth 3100 B* UV Included | 6.2 | 3.6 | 6.1 | 3.3 | 1.4 | | | |
| MacBeth 3100 Brightness (%) UV Included | 80 | 83 | 80 | 84 | 87 | | | |
| GM Break Modulus | 737 | 734 | 853 | 793 | 991 | | | |
| Roll Diameter (inches) | 7.9 | 8.0 | 8.0 | 8.1 | 8.0 | 8.0 | 7.8 | 8.2 |
| AVE Bending Length—MD (cm) | 4.0 | 4.0 | 4.2 | 4.1 | 4.8 | 4.5 | 5.3 | 3.7 |

TABLE 9

| | Single-Ply Towel Sheet | | |
|---|---|---|---|
| | Base sheet | Base sheet | Base sheet |
| Roll ID | 11171 | 9691 | 9806 |
| NSWK | 100% | 100% | 100% |
| Fabric | Prolux W13 | 36G | 44G |
| % Fabric Crepe | 5% | 5% | 5% |
| Refining (amps) | 48 | 43 | 44 |
| Suction (Hg) | 23 | 19 | 23 |
| WSR (#/T) | 13 | 13 | 11 |
| CMC (#/T) | 2 | 1 | 1 |
| Parez 631 (#/T) | 0 | 0 | 0 |
| PVOH (#/T) | 0.45 | 0.75 | 0.75 |
| PAE (#/T) | 0.15 | 0.25 | 0.25 |
| Modifier (#/T) | 0.15 | 0.25 | 0.25 |
| Yankee Speed (fpm) | 1599 | 1749 | 1749 |
| Reel Speed (fpm) | 1606 | 1760 | 1760 |
| Yankee Steam (psi) | 45 | 45 | 45 |
| Moisture % | 2.5 | 4.0 | 2.6 |
| Caliper mils/8 sht | 60.2 | 50.4 | 51.7 |
| Basis Weight lb/3000 ft^2 | 20.9 | 20.6 | 20.8 |
| Tensile MD g/3 in | 6543 | 5973 | 6191 |
| Stretch MD % | 6 | 7 | 7 |
| Tensile CD g/3 in | 3787 | 3963 | 3779 |
| Stretch CD % | 4.4 | 4.1 | 4.3 |
| Wet Tens Finch Cured-CD g/3 in. | 1097 | 1199 | 1002 |
| Tensile GM g/3 in. | 4976 | 4864 | 4836 |
| Water Abs Rate 0.1 mL sec | 20 | 22 | 20 |
| Break Modulus GM gms/% | 973 | 913 | 894 |
| Tensile Dry Ratio | 1.7 | 1.5 | 1.6 |
| Tensile Total Dry g/3 in | 10331 | 9936 | 9970 |
| Tensile Wet/Dry CD | 29% | 30% | 27% |
| Ovrhang Dwn—MD cms | 9.8 | 7.6 | 8.0 |
| Bending Len MD Yank Do cm | 4.9 | 3.8 | 4.0 |
| Bending Len MD Yank Up cm | 5.0 | 4.8 | 4.5 |
| Ovrhang Yankee Up—MD cms | 9.9 | 9.6 | 9.0 |
| AVE Bending Length—MD (cm) | 4.9 | 4.3 | 4.2 |

Note, that the present invention makes it possible to employ elevated levels of recycled fiber in the towel without compromising product quality. Also, a reduced add-on rate of Yankee coatings was preferred when running 100% recycled fiber. The addition of recycled fiber also made it possible to reduce the use of dry strength resin.

While many aspects of the invention contribute no doubt to the superior performance, it is believed that the following are salient features: the amount of fabric crepe; the furnish blend which should consist of suitable fibers; the wet end additive package which may include cationic and anionic dry and wet strength resins preferably including carboxymethyl cellulose; preferably, steam pressures are reduced for manufacture of the inventive product from about 115 psi to about 70 psi and the adhesive coating package for the Yankee is reduced by 50 or 70 percent with respect to dry creped products. So also, the modifier level in the creping adhesive is reduced substantially. The sheet moisture as it is taken from the Yankee dryer is higher when peeled in accordance with the present invention than in a dry crepe process where the moisture may be 2 percent or less. Typically, the sheet moisture in the inventive process is anywhere from about 3 to 5 percent.

A foil with a rounded front edge enhances the sheet's stability when peeling from the Yankee dryer; whereas a bow or spreader bar helps eliminate or reduce wrinkling of the sheet prior to the calender stack. The calender stack is synchronized with the reel speed prior to loading the calender stack. After the calender stack has been loaded the reel speed may be increased to get a good roll structure. Further modifications to the above examples will be readily apparent to those of skill in the art. For example, if one wanted to increase stiffness, additional starch could be added to the product.

While the invention has been described in connection with several examples, modifications to those examples within the spirit and scope of the invention will be readily apparent to those of skill in the art. In view of the foregoing discussion, relevant knowledge in the art and references including co-pending applications discussed above in connection with the Background and Detailed Description, the disclosures of which are all incorporated herein by reference, further description is deemed unnecessary.

What is claimed is:

1. A method of making a fabric-creped absorbent cellulosic sheet with improved dispensing characteristics comprising:

a) compactively dewatering a papermaking furnish to form a nascent web;

b) applying the dewatered web to a translating transfer surface moving at a transfer surface speed;

c) fabric-creping the web from the transfer surface at a consistency of from about 30 to about 60 percent utilizing a patterned creping fabric, the creping step occurring under pressure in a fabric creping nip defined between the transfer surface and the creping fabric wherein the fabric is traveling at a fabric speed slower than the speed of said transfer surface, the fabric pattern, nip parameters, velocity delta and web consistency being selected such that the web is creped from the transfer surface and transferred to the creping fabric;

d) adhering the web to a drying cylinder with a resinous adhesive coating composition;

e) drying the web on the drying cylinder; and f) peeling the web from the drying cylinder;

wherein the furnish, creping fabric and creping adhesive are selected and the velocity delta, nip parameters and web consistency, caliper and basis weight are controlled such that the MD bending length of the dried web is at least about 3.5 cm.

2. The method according to claim 1, wherein the MD bending length of the dried web is from about 3.5 cm to about 5 cm.

3. The method according to claim 1, wherein the MD bending length of the dried web is from about 3.75 cm to about 4.5 cm.

4. The method according to claim 1, operated at a fabric crepe of from about 3.5% to about 30%.

5. The method according to claim 1, operated at a fabric crepe of from about 2% to about 15%.

6. The method according to claim 1, wherein the dried web exhibits a WAR value of less than about 35 seconds.

7. The method according to claim 1, wherein the dried web exhibits a WAR value of less than about 30 seconds.

8. The method according to claim 1, wherein the dried web exhibits a WAR value of from about 10 to about 25 seconds.

9. The method according to claim 1, wherein the papermaking furnish comprises a wet strength resin.

10. The method according to claim 1, wherein the papermaking furnish comprises a dry strength resin.

11. The method according to claim 1, wherein the papermaking furnish comprises a wet strength resin and a dry strength resin selected from the group consisting of carboxymethyl cellulose, polyacrylamides and mixtures thereof, with the proviso that the wet strength resin add-on rate is less than 20 lbs per ton of papermaking fiber.

12. The method according to claim 1, wherein the resinous adhesive coating composition is employed at an add-on rate of less than about 40 mg/m$^2$.

13. The method according to claim 1, wherein the resinous adhesive coating composition is employed at an add-on rate of less than about 35 mg/m$^2$.

14. The method according to claim 1, wherein the resinous adhesive coating composition is employed at an add-on rate of less than about 25 mg/m$^2$.

15. The method according to claim 1, wherein the resinous adhesive coating composition is employed at an add-on rate of less than about 20 mg/m$^2$.

16. The method according to claim 1, wherein the resinous adhesive coating composition is employed at an add-on rate of less than about 10 mg/m$^2$.

17. The method according to claim 1, wherein the resinous adhesive composition consists essentially of a polyvinyl alcohol resin and a polyamide-epichlorohydrin resin.

18. The method according to claim 17, wherein the weight ratio of polyvinyl alcohol resin to polyamide-epichlorohydrin resin is from about 2 to about 4.

19. The method according to claim 1, wherein the prepared fiber in the furnish is predominantly softwood pulp.

20. The method according to claim 19, wherein the softwood pulp is predominantly Douglas Fir pulp.

21. The method according to claim 1, wherein the papermaking fiber in the furnish is at least 25% by weight Douglas Fir fiber.

22. The method according to claim 1, wherein the papermaking fiber in the furnish is at least 40% by weight Douglas Fir fiber.

23. The method according to claim 1, wherein the papermaking fiber in the furnish is at least 50% by weight Douglas Fir fiber.

24. The method according to claim 1, wherein the papermaking fiber in the furnish comprises recycle pulp.

25. The method according to claim 1, wherein the papermaking fiber in the furnish is at least 25% by weight recycle fiber.

26. The method according to claim 1, wherein the papermaking fiber in the furnish is at least 40% by weight recycle fiber.

27. The method according to claim 1, wherein the papermaking fiber in the furnish is at least 50% by weight recycle fiber.

28. The method according to claim 1, wherein the papermaking fiber in the furnish is at least 25% by weight recycle fiber and at least 25% by weight Douglas Fir fiber.

29. The process according to claim 1, further comprising on-line calendering the web with a calender stack prior to winding the web on a roll.

30. The process according to claim 29, wherein the calender stack is synchronized with the reel prior to loading the calender stack.

31. The method according to claim 29, wherein the web is tensioned between the drying cylinder and the calender stack.

32. The method according to claim 31, wherein the web is tensioned between the drying cylinder and calender stack with a spreader bar.

33. The method according to claim 31, wherein the web is tensioned between the drying cylinder and calender stack with a bow roll.

34. The method according to claim 29, wherein the web is tensioned between the calender stack and the reel.

35. The method according to claim 1, wherein the creping step takes place under a pressure of from 20-200 pounds per linear inch.

36. The method according to claim 1, wherein the creping step takes place under a pressure of from 40-70 pounds per linear inch.

37. A method of making a fabric-creped absorbent cellulosic sheet with improved dispensing characteristics comprising:

a) compactively dewatering a papermaking furnish to form a nascent web;

b) applying the dewatered web to a translating transfer surface moving at a transfer surface speed;

c) fabric-creping the web from the transfer surface at a consistency of from about 30 to about 60 percent utilizing a patterned creping fabric, the creping step occurring under pressure in a fabric creping nip defined between the transfer surface and the creping fabric wherein the fabric is traveling at a fabric speed slower than the speed of said transfer surface, the fabric pattern, nip parameters, velocity delta and web consistency being selected such that the web is creped from the transfer surface and transferred to the creping fabric;

wherein the fabric crepe is from about 2% to about 15%;

d) adhering the web to a drying cylinder with a resinous adhesive coating composition;

e) drying the web on the drying cylinder; and f) peeling the web from the drying cylinder;

wherein the furnish, creping fabric and creping adhesive are selected and the velocity delta, nip parameters and web consistency are controlled such that the web exhibits a WAR value of less than about 35 seconds.

38. The method according to claim 37, wherein the creping step takes place under a pressure of from 20-200 pounds per linear inch.

39. The method according to claim 37, wherein the creping step takes place under a pressure of from 40-70 pounds per linear inch.

40. A method of making a fabric-creped absorbent cellulosic sheet with improved dispensing characteristics comprising:

a) compactively dewatering a papermaking furnish to form a nascent web;

b) applying the dewatered web to a translating transfer surface moving at a transfer surface speed;

c) fabric-creping the web from the transfer surface at a consistency of from about 30 to about 60 percent utilizing a patterned creping fabric, the creping step occurring under pressure in a fabric creping nip defined between the transfer surface and the creping fabric wherein the fabric is traveling at a fabric speed slower than the speed of said transfer surface, the fabric pattern, nip parameters, velocity delta and web consistency being selected such that the web is creped from the transfer surface and transferred to the creping fabric;

wherein the fabric crepe is from about 2% to about 15%;

d) adhering the web to a drying cylinder with a resinous adhesive coating composition;

e) drying the web on the drying cylinder; and f) peeling the web from the drying cylinder;

wherein the furnish, creping fabric and creping adhesive are selected and the velocity delta, nip parameters and web consistency are controlled such that the absorbency of the web is at least about 3 g/g.

41. The method according to claim 40, wherein the web has an absorbency of at least about 3.5 g/g.

42. The method according to claim 40, wherein the web has an absorbency of at least about 4 g/g.

43. The method according to claim 40, wherein the web has an absorbency of at least about 4.5 g/g.

44. The method according to claim 40, wherein the web has an absorbency of at least about 5 g/g.

45. The method according to claim 40, wherein the web has an absorbency of at least about 5.5 g/g.

46. The method according to claim 40, wherein the creping step takes place under a pressure of from 20-200 pounds per linear inch.

47. The method according to claim 40, wherein the creping step takes place under a pressure of from 40-70 pounds per linear inch.

48. A method of making a fabric-creped absorbent cellulosic sheet with improved dispensing characteristics comprising:

a) compactively dewatering a papermaking furnish to form a nascent web;

b) applying the dewatered web to a translating transfer surface moving at a transfer surface speed;

c) fabric-creping the web from the transfer surface at a consistency of from about 30 to about 60 percent utilizing a patterned creping fabric, the creping step occurring under pressure in a fabric creping nip defined between the transfer surface and the creping fabric wherein the fabric is traveling at a fabric speed slower than the speed of said transfer surface, the fabric pattern, nip parameters, velocity delta and web consistency being selected such that the web is creped from the transfer surface and transferred to the creping fabric;

d) adhering the web to a drying cylinder with a resinous adhesive coating composition;

e) drying the web on the drying cylinder;

f) peeling the web from the drying cylinder; and g) stabilizing the web utilizing an airfoil with a rounded edge in proximity to the drying cylinder.

49. The method according to claim 48, further comprising stabilizing the web over an open draw utilizing at least one additional air foil.

50. The method according to claim 48, further comprising using at least two additional air foils to stabilize the web.

51. The method according to claim 48, further comprising on-line calendering the web with a calendering stack located between the drying cylinder and a wind-up reel.

52. The method according to claim 51, wherein the calender stack is synchronized with the wind-up reel prior to loading the calender stack.

53. The method according to claim 48, wherein the creping step takes place under a pressure of from 20-200 pounds per linear inch.

54. The method according to claim 48, wherein the creping step takes place under a pressure of from 40-70 pounds per linear inch.

55. A method of making a fabric-creped absorbent cellulosic sheet with improved dispensing characteristics comprising:

a) compactively dewatering a papermaking furnish to form a nascent web having an apparently random distribution of papermaking fiber;

b) applying the dewatered web having the apparently random fiber distribution to a translating transfer surface moving at a transfer surface speed;

c) fabric-creping the web from the transfer surface at a consistency of from about 30 to about 60 percent utilizing a patterned creping fabric, the creping step occurring under pressure in a fabric creping nip defined between the transfer surface and the creping fabric wherein the fabric is traveling at a fabric speed slower than the speed of said transfer surface, the fabric pattern, nip parameters, velocity delta and web consistency being selected such that the web is creped from the transfer surface and redistributed on the creping fabric;

d) adhering the web to a drying cylinder with a resinous adhesive coating composition;

e) drying the web on the drying cylinder; and f) peeling the web from the drying cylinder;

wherein the furnish, creping fabric and creping adhesive are selected and the velocity delta, nip parameters and web consistency, caliper and basis weight are controlled such that the MD bending length of the dried web is at least about 3.5 cm.

56. The method according to claim 55, wherein the creping step takes place under a pressure of from 20-200 pounds per linear inch.

57. The method according to claim 55, wherein the creping step takes place under a pressure of from 40-70 pounds per linear inch.

* * * * *